US009705255B2

(12) United States Patent
Atkinson et al.

(10) Patent No.: US 9,705,255 B2
(45) **Date of Patent: *Jul. 11, 2017**

(54) HIGH FREQUENCY ELECTRICAL CONNECTOR

(71) Applicant: Amphenol Corporation, Wallingford Center, CT (US)

(72) Inventors: Prescott B. Atkinson, Nottingham, NH (US); Brian Kirk, Amherst, NH (US); Mark W. Gailus, Concord, MA (US); David Manter, Windham, NH (US); Thomas S. Cohen, New Boston, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/948,171

(22) Filed: Nov. 20, 2015

(65) Prior Publication Data

US 2016/0149343 A1 May 26, 2016

Related U.S. Application Data

(63) Continuation of application No. 14/472,270, filed on Aug. 28, 2014, now Pat. No. 9,219,335, which is a (Continued)

(51) Int. Cl.
*H01R 13/6461* (2011.01)
*H01R 13/6471* (2011.01)

(Continued)

(52) U.S. Cl.
CPC ..... *H01R 13/6461* (2013.01); *H01R 12/724* (2013.01); *H01R 12/735* (2013.01);

(Continued)

(58) Field of Classification Search
CPC .. H01R 12/585; H01R 12/724; H01R 12/735; H01R 13/504; H01R 13/514;

(Continued)

(56) References Cited

U.S. PATENT DOCUMENTS 2,996,710 A 8/1961 Pratt
3,002,162 A 9/1961 Garstang (Continued)

FOREIGN PATENT DOCUMENTS

CN 1398446 2/2003
DE 102006044479 A1 5/2007

(Continued)

OTHER PUBLICATIONS

[No Author Listed], High Speed Backplane Connectors . Tyco Electronics. Product Catalog No. 1773095. Revised Dec. 2008. 1-40 pages.

(Continued)

*Primary Examiner* — Tulsidas C Patel
*Assistant Examiner* — Travis Chambers
(74) *Attorney, Agent, or Firm* — Wolf, Greenfield & Sacks, P.C.

(57) ABSTRACT

An improved broadside coupled, open pin field connector. The connector incorporates lossy material to selectively dampen resonance within pairs of conductive members connected to ground when the connector is mounted to a printed circuit board. The material may also decrease cross-talk and mode conversion. The lossy material is selectively positioned to substantially dampen resonances along pairs that may be connected to ground without unacceptably attenuating signals carried by other pairs. The lossy material may be selectively positioned near mating contact portions of the conductive members. Multiple techniques are described for selectively positioning the lossy material, (Continued)

including molding, inserting lossy members into a housing or coating surfaces of the connector housing. By using material of relatively low loss, loss when the conductive members are used to carry signals is relatively low, but an appreciable attenuation of resonances is provided on pairs connected to ground.

20 Claims, 13 Drawing Sheets

Related U.S. Application Data continuation of application No. 13/029,052, filed on Feb. 16, 2011, now Pat. No. 8,864,521, which is a continuation-in-part of application No. 11/476,758, filed on Jun. 29, 2006, now Pat. No. 8,083,553, and a continuation-in-part of application No. 11/476,831, filed on Jun. 29, 2006, now Pat. No. 7,914,304, and a continuation of application No. 12/533,867, filed on Jul. 31, 2009, now abandoned, which is a continuation-in-part of application No. 11/476,831.

(60) Provisional application No. 60/695,264, filed on Jun. 30, 2005, provisional application No. 61/085,472, filed on Aug. 1, 2008.

(51) Int. Cl.

| | |
|---|---|
| ***H01R 13/6598*** | (2011.01) |
| ***H01R 12/72*** | (2011.01) |
| ***H01R 12/73*** | (2011.01) |
| ***H01R 13/504*** | (2006.01) |
| ***H01R 13/514*** | (2006.01) |
| ***H01R 13/6477*** | (2011.01) |
| ***H01R 13/6585*** | (2011.01) |
| ***H01R 13/6587*** | (2011.01) |
| ***H01R 13/658*** | (2011.01) |
| ***H01R 24/68*** | (2011.01) |
| *H01R 12/58* | (2011.01) |
| *H01R 24/62* | (2011.01) |

(52) U.S. Cl.

CPC ..... *H01R 13/504* (2013.01); *H01R 13/514* (2013.01); *H01R 13/6471* (2013.01); *H01R 13/6477* (2013.01); *H01R 13/658* (2013.01); *H01R 13/6585* (2013.01); *H01R 13/6587* (2013.01); *H01R 13/6598* (2013.01); *H01R 24/68* (2013.01); *H01R 12/585* (2013.01); *H01R 24/62* (2013.01)

(58) Field of Classification Search

CPC ..... H01R 13/6461; H01R 13/6471; H01R 13/6477; H01R 13/658; H01R 13/6585; H01R 13/6587; H01R 13/6598; H01R 24/62; H01R 24/68

USPC ..... 439/607.02, 295, 605, 607.01–607.11, 439/608, 701

See application file for complete search history.

(56) References Cited

U.S. PATENT DOCUMENTS

| | | | |
|---|---|---|---|
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |
| 4,155,613 | A | 5/1979 | Brandeau |
| 4,175,821 | A | 11/1979 | Hunter |
| 4,195,272 | A | 3/1980 | Boutros |
| 4,276,523 | A | 6/1981 | Boutros et al. |
| 4,371,742 | A | 2/1983 | Manly |
| 4,408,255 | A | 10/1983 | Adkins |
| 4,447,105 | A | 5/1984 | Ruehl |
| 4,457,576 | A | 7/1984 | Cosmos et al. |
| 4,471,015 | A | 9/1984 | Ebneth et al. |
| 4,472,765 | A | 9/1984 | Hughes |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,607,907 | A | 8/1986 | Bogursky |
| 4,636,752 | A | 1/1987 | Saito |
| 4,655,518 | A | 4/1987 | Johnson et al. |
| 4,674,812 | A | 6/1987 | Thom et al. |
| 4,682,129 | A | 7/1987 | Bakermans et al. |
| 4,686,607 | A | 8/1987 | Johnson |
| 4,728,762 | A | 3/1988 | Roth et al. |
| 4,751,479 | A | 6/1988 | Parr |
| 4,761,147 | A | 8/1988 | Gauthier |
| 4,836,791 | A | 6/1989 | Grabbe et al. |
| 4,846,724 | A | 7/1989 | Sasaki et al. |
| 4,846,727 | A | 7/1989 | Glover et al. |
| 4,871,316 | A | 10/1989 | Herrell et al. |
| 4,876,630 | A | 10/1989 | Dara |
| 4,878,155 | A | 10/1989 | Conley |
| 4,889,500 | A | 12/1989 | Lazar et al. |
| 4,902,243 | A | 2/1990 | Davis |
| 4,948,922 | A | 8/1990 | Varadan et al. |
| 4,970,354 | A | 11/1990 | Iwasa et al. |
| 4,992,060 | A | 2/1991 | Meyer |
| 5,000,700 | A | 3/1991 | Masubuchi et al. |
| 5,141,454 | A | 8/1992 | Garrett et al. |
| 5,150,086 | A | 9/1992 | Ito |
| 5,168,252 | A | 12/1992 | Naito |
| 5,168,432 | A | 12/1992 | Murphy et al. |
| 5,246,388 | A | 9/1993 | Collins et al. |
| 5,259,773 | A | 11/1993 | Champion et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,335,146 | A | 8/1994 | Stucke |
| 5,340,334 | A | 8/1994 | Nguyen |
| 5,346,410 | A | 9/1994 | Moore, Jr. |
| 5,352,123 | A | 10/1994 | Sample et al. |
| 5,429,520 | A | 7/1995 | Morlion et al. |
| 5,429,521 | A | 7/1995 | Morlion et al. |
| 5,456,619 | A | 10/1995 | Belopolsky et al. |
| 5,461,392 | A | 10/1995 | Mott et al. |
| 5,496,183 | A | 3/1996 | Soes et al. |
| 5,499,935 | A | 3/1996 | Powell |
| 5,551,893 | A | 9/1996 | Johnson |
| 5,562,497 | A | 10/1996 | Yagi et al. |
| 5,597,328 | A | 1/1997 | Mouissie |
| 5,605,469 | A | 2/1997 | Wellinsky et al. |
| 5,651,702 | A | 7/1997 | Hanning et al. |
| 5,669,789 | A | 9/1997 | Law |
| 5,755,597 | A | 5/1998 | Panis et al. |
| 5,795,191 | A | 8/1998 | Preputnick et al. |
| 5,796,323 | A | 8/1998 | Uchikoba et al. |
| 5,831,491 | A | 11/1998 | Buer et al. |
| 5,870,528 | A | 2/1999 | Fukuda |
| 5,887,158 | A | 3/1999 | Sample et al. |
| 5,924,899 | A | 7/1999 | Paagman |
| 5,931,686 | A | 8/1999 | Sasaki et al. |
| 5,959,591 | A | 9/1999 | Aurand |
| 5,971,809 | A | 10/1999 | Ho |
| 5,980,321 | A | 11/1999 | Cohen et al. |
| 5,981,869 | A | 11/1999 | Kroger |
| 5,982,253 | A | 11/1999 | Perrin et al. |
| 5,993,259 | A | 11/1999 | Stokoe et al. |
| 6,019,616 | A | 2/2000 | Yagi et al. |
| 6,083,047 | A | 7/2000 | Paagman |
| 6,102,747 | A | 8/2000 | Paagman |
| 6,132,255 | A | 10/2000 | Verhoeven |
| 6,146,202 | A | 11/2000 | Ramey et al. |
| 6,152,747 | A | 11/2000 | McNamara |

(56) References Cited

U.S. PATENT DOCUMENTS 6,163,464 A 12/2000 Ishibashi et al.
6,168,469 B1 1/2001 Lu
6,171,115 B1 1/2001 Mickievicz et al.
6,174,202 B1 1/2001 Mitra
6,174,203 B1 1/2001 Asao
6,174,944 B1 1/2001 Chiba et al.
6,217,372 B1 4/2001 Reed
6,238,245 B1 5/2001 Stokoe et al.
6,267,604 B1 7/2001 Mickievicz et al.
6,293,827 B1 9/2001 Stokoe
6,299,483 B1 10/2001 Cohen et al.
6,299,492 B1 10/2001 Pierini et al.
6,328,572 B1 12/2001 Higashida et al.
6,343,955 B2 2/2002 Billman et al.
6,343,957 B1 2/2002 Kuo et al.
6,347,962 B1 2/2002 Kline
6,350,134 B1 2/2002 Fogg et al.
6,364,711 B1 4/2002 Berg et al.
6,364,713 B1 4/2002 Kuo
6,375,510 B2 4/2002 Asao
6,379,188 B1 4/2002 Cohen et al.
6,380,485 B1 4/2002 Beaman et al.
6,392,142 B1 5/2002 Uzuka et al.
6,394,839 B2 5/2002 Reed
6,398,588 B1 6/2002 Bickford
6,409,543 B1 6/2002 Astbury, Jr. et al.
6,428,344 B1 8/2002 Reed
6,435,913 B1 8/2002 Billman
6,454,605 B1 9/2002 Bassler et al.
6,461,202 B2 10/2002 Kline
6,482,017 B1 11/2002 Van Doorn
6,503,103 B1 1/2003 Cohen et al.
6,506,076 B2 1/2003 Cohen et al.
6,517,360 B1 2/2003 Cohen
6,520,803 B1 2/2003 Dunn
6,527,587 B1 3/2003 Ortega et al.
6,528,737 B1 3/2003 Kwong et al.
6,530,790 B1 3/2003 McNamara et al.
6,537,087 B2 3/2003 McNamara et al.
6,538,899 B1 3/2003 Krishnamurthi et al.
6,540,522 B2 4/2003 Sipe
6,540,559 B1 4/2003 Kemmick et al.
6,541,712 B1 4/2003 Gately et al.
6,554,647 B1 4/2003 Cohen et al.
6,565,387 B2 5/2003 Cohen
6,579,116 B2 6/2003 Brennan et al.
6,592,381 B2 7/2003 Cohen et al.
6,595,802 B1 7/2003 Watanabe et al.
6,602,095 B2 8/2003 Astbury, Jr. et al.
6,607,402 B2 8/2003 Cohen et al.
6,608,762 B2 8/2003 Patriche
6,609,933 B2 8/2003 Yamasaki
6,612,871 B1 9/2003 Givens
6,616,482 B2 9/2003 De La Cruz et al.
6,616,864 B1 9/2003 Jiang et al.
6,652,318 B1 11/2003 Winings et al.
6,652,319 B1 11/2003 Billman
6,655,966 B2 12/2003 Rothermel et al.
6,663,427 B1 12/2003 Billman et al.
6,663,429 B1 12/2003 Korsunsky et al.
6,705,895 B2 3/2004 Hasircoglu
6,709,294 B1 3/2004 Cohen et al.
6,713,672 B1 3/2004 Stickney
6,717,825 B2 4/2004 Volstorf
6,722,897 B1 4/2004 Wu
6,743,057 B2 6/2004 Davis et al.
6,762,941 B2 7/2004 Roth
6,764,341 B2 7/2004 Lappoehn
6,776,645 B2 8/2004 Roth et al.
6,776,659 B1 8/2004 Stokoe et al.
6,786,771 B2 9/2004 Gailus
6,808,419 B1 10/2004 Korsunsky et al.
6,808,420 B2 10/2004 Whiteman, Jr. et al.
6,814,619 B1 11/2004 Stokoe et al.
6,816,486 B1 11/2004 Rogers
6,817,870 B1 11/2004 Kwong et al.
6,823,587 B2 11/2004 Reed
6,830,483 B1 12/2004 Wu
6,857,899 B2 2/2005 Reed et al.
6,872,085 B1 3/2005 Cohen et al.
6,875,031 B1 4/2005 Korsunsky et al.
6,899,566 B2 5/2005 Kline et al.
6,903,939 B1 6/2005 Chea, Jr. et al.
6,913,490 B2 7/2005 Whiteman, Jr. et al.
6,932,649 B1 8/2005 Rothermel et al.
6,957,967 B2 10/2005 Petersen et al.
6,960,103 B2 11/2005 Tokunaga
6,971,916 B2 12/2005 Tokunaga
6,979,202 B2 12/2005 Benham et al.
6,979,226 B2 12/2005 Otsu et al.
7,021,969 B2 4/2006 Matsunaga
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,137,849 B2 11/2006 Nagata
7,163,421 B1 1/2007 Cohen et al.
7,182,643 B2 2/2007 Winings et al.
7,229,318 B2 6/2007 Winings et al.
7,270,573 B2 9/2007 Houtz
7,285,018 B2 10/2007 Kenny et al.
7,303,427 B2 12/2007 Swain
7,309,239 B2 12/2007 Shuey et al.
7,316,585 B2 1/2008 Smith et al.
7,322,855 B2 1/2008 Mongold et al.
7,335,063 B2 2/2008 Cohen et al.
7,347,721 B2 3/2008 Kameyama
7,351,114 B2 4/2008 Benham et al.
7,365,269 B2 4/2008 Donazzi et al.
7,371,117 B2 5/2008 Gailus
7,390,218 B2 6/2008 Smith et al.
7,494,383 B2 2/2009 Cohen et al.
7,540,781 B2 6/2009 Kenny et al.
7,554,096 B2 6/2009 Ward et al.
7,581,990 B2 9/2009 Kirk et al.
7,585,186 B2 9/2009 McAlonis et al.
7,588,464 B2 9/2009 Kim
7,588,467 B2 9/2009 Chang
7,594,826 B2 9/2009 Kobayashi et al.
7,674,133 B2 3/2010 Fogg et al.
7,699,663 B1 4/2010 Little et al.
7,722,401 B2 5/2010 Kirk et al.
7,731,537 B2 6/2010 Amleshi et al.
7,753,731 B2 7/2010 Cohen et al.
7,758,357 B2 7/2010 Pan et al.
7,771,233 B2 8/2010 Gailus
7,794,240 B2 9/2010 Cohen et al.
7,874,873 B2 1/2011 Do et al.
7,887,371 B2 2/2011 Kenny et al.
7,906,730 B2 3/2011 Atkinson et al.
7,914,304 B2 3/2011 Cartier et al.
7,927,143 B2 4/2011 Helster et al.
8,083,553 B2 * 12/2011 Manter ..... H01R 13/514 439/607.05
8,182,289 B2 5/2012 Stokoe et al.
8,215,968 B2 7/2012 Cartier et al.
8,267,721 B2 9/2012 Minich
8,272,877 B2 9/2012 Stokoe et al.
8,371,875 B2 2/2013 Gailus
8,382,524 B2 2/2013 Khilchenko et al.
8,657,627 B2 2/2014 McNamara et al.
8,715,003 B2 5/2014 Buck et al.
8,771,016 B2 * 7/2014 Atkinson ..... H01R 13/6474 439/607.07
8,864,521 B2 10/2014 Atkinson et al.
8,926,377 B2 1/2015 Kirk et al.
8,944,831 B2 2/2015 Stoner et al.
8,998,642 B2 * 4/2015 Manter ..... H01R 13/514 439/607.07
9,004,942 B2 4/2015 Paniagua
9,022,806 B2 5/2015 Cartier, Jr. et al.
9,028,201 B2 5/2015 Pummell et al.
9,028,281 B2 5/2015 Kirk et al.

(56) References Cited

U.S. PATENT DOCUMENTS

| | | | |
|---|---|---|---|
| 9,124,009 | B2 | 9/2015 | Atkinson et al. |
| 9,219,335 | B2 * | 12/2015 | Atkinson ..... H01R 13/6471 |
| 9,225,085 | B2 | 12/2015 | Cartier, Jr. et al. |
| 9,300,074 | B2 | 3/2016 | Gailus |
| 9,450,344 | B2 | 9/2016 | Cartier, Jr. et al. |
| 9,484,674 | B2 | 11/2016 | Cartier, Jr. et al. |
| 2001/0012730 | A1 | 8/2001 | Ramey et al. |
| 2001/0042632 | A1 | 11/2001 | Manov et al. |
| 2001/0046810 | A1 | 11/2001 | Cohen et al. |
| 2002/0042223 | A1 | 4/2002 | Belopolsky et al. |
| 2002/0086582 | A1 | 7/2002 | Nitta et al. |
| 2002/0089464 | A1 | 7/2002 | Joshi |
| 2002/0098738 | A1 | 7/2002 | Astbury et al. |
| 2002/0102885 | A1 | 8/2002 | Kline |
| 2002/0111068 | A1 | 8/2002 | Cohen et al. |
| 2002/0111069 | A1 | 8/2002 | Astbury et al. |
| 2002/0123266 | A1 | 9/2002 | Ramey et al. |
| 2002/0168898 | A1 | 11/2002 | Billman et al. |
| 2002/0181215 | A1 | 12/2002 | Guenthner |
| 2003/0003803 | A1 | 1/2003 | Billman et al. |
| 2003/0008561 | A1 | 1/2003 | Lappoehn |
| 2003/0022555 | A1 | 1/2003 | Vicich et al. |
| 2003/0143894 | A1 | 7/2003 | Kline et al. |
| 2003/0220018 | A1 | 11/2003 | Winings et al. |
| 2003/0220021 | A1 | 11/2003 | Whiteman, Jr. et al. |
| 2004/0020674 | A1 | 2/2004 | McFadden et al. |
| 2004/0043661 | A1 | 3/2004 | Okada et al. |
| 2004/0072473 | A1 | 4/2004 | Wu |
| 2004/0115968 | A1 | 6/2004 | Cohen |
| 2004/0121652 | A1 | 6/2004 | Gailus |
| 2004/0171305 | A1 | 9/2004 | McGowan et al. |
| 2004/0196112 | A1 | 10/2004 | Welbon et al. |
| 2004/0224559 | A1 | 11/2004 | Nelson et al. |
| 2004/0235352 | A1 | 11/2004 | Takemasa |
| 2004/0259419 | A1 | 12/2004 | Payne et al. |
| 2005/0020135 | A1 | 1/2005 | Whiteman et al. |
| 2005/0039331 | A1 | 2/2005 | Smith |
| 2005/0048838 | A1 | 3/2005 | Korsunsky et al. |
| 2005/0048842 | A1 | 3/2005 | Benham et al. |
| 2005/0070160 | A1 | 3/2005 | Cohen et al. |
| 2005/0133245 | A1 | 6/2005 | Katsuyama et al. |
| 2005/0148239 | A1 | 7/2005 | Hull et al. |
| 2005/0176300 | A1 | 8/2005 | Hsu et al. |
| 2005/0176835 | A1 | 8/2005 | Kobayashi et al. |
| 2005/0215121 | A1 | 9/2005 | Tokunaga |
| 2005/0277315 | A1 | 12/2005 | Mongold et al. |
| 2005/0283974 | A1 | 12/2005 | Richard et al. |
| 2005/0287869 | A1 | 12/2005 | Kenny et al. |
| 2006/0019517 | A1 | 1/2006 | Raistrick et al. |
| 2006/0019538 | A1 | 1/2006 | Davis et al. |
| 2006/0024983 | A1 | 2/2006 | Cohen et al. |
| 2006/0024984 | A1 | 2/2006 | Cohen et al. |
| 2006/0068640 | A1 | 3/2006 | Gailus |
| 2006/0073709 | A1 | 4/2006 | Reid |
| 2006/0104010 | A1 | 5/2006 | Donazzi et al. |
| 2006/0292932 | A1 | 12/2006 | Benham et al. |
| 2007/0004282 | A1 | 1/2007 | Cohen et al. |
| 2007/0004828 | A1 | 1/2007 | Khabbaz |
| 2007/0021000 | A1 | 1/2007 | Laurx |
| 2007/0021001 | A1 | 1/2007 | Laurx et al. |
| 2007/0021002 | A1 | 1/2007 | Laurx et al. |
| 2007/0021003 | A1 | 1/2007 | Laurx et al. |
| 2007/0021004 | A1 | 1/2007 | Laurx et al. |
| 2007/0037419 | A1 | 2/2007 | Sparrowhawk |
| 2007/0042639 | A1 | 2/2007 | Manter et al. |
| 2007/0054554 | A1 | 3/2007 | Do et al. |
| 2007/0059961 | A1 | 3/2007 | Cartier et al. |
| 2007/0111597 | A1 | 5/2007 | Kondou et al. |
| 2007/0141872 | A1 | 6/2007 | Szczesny et al. |
| 2007/0218765 | A1 | 9/2007 | Cohen et al. |
| 2008/0194146 | A1 | 8/2008 | Gailus |
| 2008/0246555 | A1 | 10/2008 | Kirk et al. |
| 2008/0248658 | A1 | 10/2008 | Cohen et al. |
| 2008/0248659 | A1 | 10/2008 | Cohen et al. |
| 2008/0248660 | A1 | 10/2008 | Kirk et al. |
| 2009/0011641 | A1 | 1/2009 | Cohen et al. |
| 2009/0011645 | A1 | 1/2009 | Laurx et al. |
| 2009/0117386 | A1 | 5/2009 | Vacanti et al. |
| 2009/0239395 | A1 | 9/2009 | Cohen et al. |
| 2009/0291593 | A1 | 11/2009 | Atkinson et al. |
| 2010/0081302 | A1 | 4/2010 | Atkinson et al. |
| 2010/0294530 | A1 | 11/2010 | Atkinson et al. |
| 2011/0003509 | A1 | 1/2011 | Gailus |
| 2011/0104948 | A1 | 5/2011 | Girard, Jr. et al. |
| 2011/0212649 | A1 | 9/2011 | Stokoe et al. |
| 2011/0212650 | A1 | 9/2011 | Amleshi et al. |
| 2011/0230095 | A1 | 9/2011 | Atkinson et al. |
| 2011/0230096 | A1 | 9/2011 | Atkinson et al. |
| 2011/0287663 | A1 | 11/2011 | Gailus et al. |
| 2012/0094536 | A1 | 4/2012 | Khilchenko et al. |
| 2012/0156929 | A1 | 6/2012 | Manter et al. |
| 2012/0202363 | A1 | 8/2012 | McNamara et al. |
| 2012/0202386 | A1 | 8/2012 | McNamara et al. |
| 2012/0214343 | A1 | 8/2012 | Buck et al. |
| 2012/0214344 | A1 | 8/2012 | Cohen et al. |
| 2013/0012038 | A1 | 1/2013 | Kirk et al. |
| 2013/0017733 | A1 | 1/2013 | Kirk et al. |
| 2013/0078870 | A1 | 3/2013 | Milbrand, Jr. |
| 2013/0109232 | A1 | 5/2013 | Paniaqua |
| 2013/0196553 | A1 | 8/2013 | Gailus |
| 2013/0217263 | A1 | 8/2013 | Pan |
| 2013/0225006 | A1 | 8/2013 | Khilchenko et al. |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0057498 | A1 | 2/2014 | Cohen |
| 2014/0273557 | A1 | 9/2014 | Cartier, Jr. et al. |
| 2014/0273627 | A1 | 9/2014 | Cartier, Jr. et al. |
| 2015/0056856 | A1 | 2/2015 | Atkinson et al. |
| 2015/0236451 | A1 | 8/2015 | Cartier, Jr. et al. |
| 2015/0236452 | A1 | 8/2015 | Cartier, Jr. et al. |
| 2015/0255926 | A1 | 9/2015 | Paniagua |

FOREIGN PATENT DOCUMENTS

| | | | |
|---|---|---|---|
| EP | 1 779 472 | A1 | 5/2007 |
| EP | 2 169 770 | A2 | 3/2010 |
| GB | 1272347 | A | 4/1972 |
| JP | 07302649 | A | 11/1995 |
| JP | 2002-117938 | A | 4/2002 |
| JP | 2003-17193 | A | 1/2003 |
| WO | WO 88/05218 | A1 | 7/1988 |
| WO | WO 98/35409 | A1 | 8/1998 |
| WO | WO 01/39332 | A1 | 5/2001 |
| WO | WO 01/57963 | A2 | 8/2001 |
| WO | WO 03/047049 | A1 | 6/2003 |
| WO | WO 2004/034539 | A1 | 4/2004 |
| WO | WO 2004/059794 | A2 | 7/2004 |
| WO | WO 2004/059801 | A1 | 7/2004 |
| WO | WO 2005/011062 | A2 | 2/2005 |
| WO | WO 2006/039277 | A1 | 4/2006 |
| WO | WO 2007/005597 | A2 | 1/2007 |
| WO | WO 2007/005598 | A2 | 1/2007 |
| WO | WO 2007/005599 | A1 | 1/2007 |
| WO | WO 2008/124052 | A2 | 10/2008 |
| WO | WO 2008/124054 | A2 | 10/2008 |
| WO | WO 2008/124057 | A1 | 10/2008 |
| WO | WO 2008/124101 | A2 | 10/2008 |
| WO | WO 2010/039188 | A1 | 4/2010 |

OTHER PUBLICATIONS

[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre . . . Last archive date Apr. 6, 2008.

Extended European Search Report mailed Jan. 24, 2012 for Application No. EP 11166820.8.

International Search Report with Written Opinion mailed Oct. 31, 2007 for Application No. PCT/US2006/025562.

(56) References Cited

OTHER PUBLICATIONS

International Search Report and Written Opinion mailed Jan. 26, 2006 for Application No. PCT/US2005/034605.
International Search Report and Written Opinion mailed Mar. 14, 2011 for Application No. PCT/US2010/056482.
International Preliminary Report on Patentability mailed May 24, 2012 for Application No. PCT/US2010/056482.
International Search Report and Written Opinion mailed Nov. 22, 2011for Application No. PCT/US2011/026139.
International Preliminary Report on Patentability mailed Sep. 7, 2012 for Application No. PCT/US2011/026139.
International Search Report and Written Opinion mailed Jul. 28, 2011 for Application No. PCT/US2011/034747.
International Search Report and Written Opinion mailed Sep. 12, 2012 for Application No. PCT/US2012/023689.
International Preliminary Report on Patentability mailed Aug. 15, 2013 for Application No. PCT/US2012/023689.
International Search Report and Written Opinion mailed Mar. 29, 2013 for Application No. PCT/US2012/060610.
International Search Report and Written Opinion mailed May 13, 2015 for Application No. PCT/US2015/012463.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], High Speed Backplane Connectors. Tyco Electronics. Product Catalog No. 1773095. Revised Dec. 2008 1-40 pages.
[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre. . . Last archive date Apr. 6, 2008.
Beaman, High Performance Mainframe Computer Cables, Electronic Components and Technology Conference. 1997;911-7.
Reich et al., Microwave Theory and Techniques. Boston Technical Publishers, Inc. 1965;182-91.
Shi et al, Improving Signal Integrity in Circuit Boards by Incorporating Absorbing Materials. 2001 Proceedings. 51st Electronic Components and Technology Conference, Orlando FL. 2001:1451-56.

* cited by examiner

HIGH FREQUENCY ELECTRICAL CONNECTOR

CROSS-REFERENCE TO RELATED APPLICATIONS

This application is a continuation of U.S. patent application Ser. No. 14/472,270, filed on Aug. 28, 2014, now U.S. Pat. No. 9,219,335, titled "HIGH FREQUENCY ELECTRICAL CONNECTOR," which is a continuation of U.S. patent application Ser No. 13/029,052, filed on Feb. 16, 2011, now U.S. Pat. No. 8,864,521, titled "HIGH FREQUENCY ELECTRICAL CONNECTOR," which is a continuation-in-part to U.S. patent application Ser. No. 11/476,758, now U.S. Pat. No. 8,083,553, filed on Jun. 29, 2006, titled "CONNECTOR WITH IMPROVED SHIELDING IN MATING CONTACT REGION," which claims priority to U.S. Provisional Patent Application No. 60/695,264, filed on Jun. 30, 2005, titled "CONNECTOR WITH IMPROVED SHIELDING IN MATING CONTACT REGION." U.S. patent application Ser. No. 13/029,052, filed on Feb. 16, 2011, now U.S. Pat. No. 8,864,521, is a continuation-in- part of U.S. patent application Ser. No. 11/476,831, filed on Jun. 29, 2006, now U.S. Pat. No. 7,914,304, titled "ELECTRICAL CONNECTOR FOR INTERCONNECTION ASSEMBLY," and is a continuation of U.S. patent application Ser. No. 12/533,867, filed on Jul. 31, 2009, now Abandoned, titled "HIGH FREQUENCY ELECTRICAL CONNECTOR," which is a continuation-in-part of U.S. patent application Ser. No. 11/476,831, filed on Jun. 29, 2006, now U.S. Pat. No. 7,914,304, titled "ELECTRICAL CONNECTOR FOR INTERCONNECTION ASSEMBLY," and claims priority to U.S. Provisional Patent Application No. 61/085,472, filed on Aug. 1, 2008, titled "HIGH FREQUENCY BROADSIDE-COUPLED ELECTRICAL CONNECTOR." All of the above-referenced applications are incorporated herein by reference in their entireties.

BACKGROUND OF INVENTION

1. Field of Invention

This invention relates generally to electrical interconnection systems and more specifically to improved signal integrity in interconnection systems, particularly in high speed electrical connectors.

2. Discussion of Related Art

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, metal members are often placed between or around adjacent signal conductors. The metal acts as a shield to prevent signals carried on one conductor from creating "crosstalk" on another conductor. The metal also impacts the impedance of each conductor, which can further contribute to desirable electrical properties.

As signal frequencies increase, there is a greater possibility of electrical noise being generated in the connector in forms such as reflections, crosstalk and electromagnetic radiation. Therefore, the electrical connectors are designed to limit crosstalk between different signal paths and to control the characteristic impedance of each signal path. Shield members are often placed adjacent the signal conductors for this purpose.

Crosstalk between different signal paths through a connector can be limited by arranging the various signal paths so that they are spaced further from each other and nearer to a shield, such as a grounded plate. Thus, the different signal paths tend to electromagnetically couple more to the shield and less with each other. For a given level of crosstalk, the signal paths can be placed closer together when sufficient electromagnetic coupling to the ground conductors is maintained.

Although shields for isolating conductors from one another are typically made from metal components, U.S. Pat. No. 6,709,294 (the '294 patent), which is assigned to the same assignee as the present application and which is hereby incorporated by reference in its entirety, describes making an extension of a shield plate in a connector from conductive plastic.

In some connectors, shielding is provided by conductive members shaped and positioned specifically to provide shielding. These conductive members are designed to be connected to a reference potential, or ground, when mounted on a printed circuit board. Such connectors are said to have a dedicated ground system.

In other connectors, all conductive members may be generally of the same shape and positioned in a regular array. If shielding is desired within the connector, some of the conductive members may be connected to ground. All other conductive members may be used to carry signals. Such a connector, called an "open pin field connector," provides flexibility in that the number and specific conductive members that are grounded, and conversely the number and specific conductive members available to carry signals, can be selected when a system using the connector is designed. However, the shape and positioning of shielding members is constrained by the need to ensure that those conductive members, if connected to carry a signal rather than to provide a ground, provide a suitable path for carrying signals.

Other techniques may be used to control the performance of a connector. Transmitting signals differentially can also reduce crosstalk. Differential signals are carried by a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. Conventionally, no shielding is desired between the conducting paths of the pair, but shielding may be used between differential pairs.

Examples of differential electrical connectors are shown in U.S. Pat. Nos. 6,293,827, 6,503,103, 6,776,659, and 7,163,421, all of which are assigned to the assignee of the present application and are hereby incorporated by reference in their entireties.

Differential connectors are generally regarded as "edge coupled" or "broadside coupled." In both types of connectors the conductive members that carry signals are generally rectangular in cross section. Two opposing sides of the rectangle are wider than the other sides, forming the broad sides of the conductive member. When pairs of conductive members are positioned with broad sides of the members of the pair closer to each other than to adjacent conductive members, the connector is regarded as being broadside coupled. Conversely, if pairs of conductive members are positioned with the narrower edges joining the broad sides closer to each other than to adjacent conductive members, the connector is regarded as being edge coupled.

U.S. Pat. No. 6,503,103 and U.S. Published applications U.S. 2007/0021000, U.S. 2007/0021001, U.S. 2007/0021002, U.S. 2007/0021003 and U.S. 2007/0021004 disclose broadside coupled connectors, with the published applications disclosing an open pin field, broadside coupled connector.

Electrical characteristics of a connector may also be controlled through the use of absorptive material. U.S. Pat. No. 6,786,771, which is assigned to the assignee of the present application and which is hereby incorporated by reference in its entirety, describes the use of absorptive material to reduce unwanted resonances and improve connector performance, particularly at high speeds (for example, signal frequencies of 1 GHz or greater, particularly above 3 GHz).

U.S. Published Application 2006/0068640 and U.S. patent application Ser. No. 12/062,577, both of which are assigned to the assignee of the present invention and are hereby incorporated by reference in their entireties, describe the use of lossy material to improve connector performance.

SUMMARY

An improved electrical connector is provided through the selective positioning of lossy material adjacent conductive members within the connector. In some embodiments, the lossy material is included in a broadside coupled, open pin field connector. In embodiments in which there are no conductive members specifically designed to be ground conductors, the lossy material may be placed adjacent to some conductive members that will be used to carry signals. The positioning of the lossy material relative to conductive members may be selected to reduce resonance in pairs of conductive elements if used as grounds without causing an unacceptable decrease in signal conductive elements used to carry signals.

The lossy material may be positioned adjacent mating contact portions of conductive members in the connector, such as by incorporating lossy material into a forward housing portion of the connector. For a broadside coupled connector the lossy material may be positioned between pairs of columns of conductive members, such as through the use of lossy inserts.

For embodiments in which lossy material is positioned adjacent the mating contact portions, a forward housing portion with lossy material may be formed in any one of multiple ways to provide the desired positioning of the lossy material. The forward housing portion, for example, may be formed as a member separate from subassemblies incorporating conductive members. The lossy material may be molded into such a housing, or such a housing may formed with slots into which lossy members may be inserted.

In other embodiments, the forward housing portion may be formed as part of the same subassembly that holds the conductive members. Lossy material may be positioned between mating contact portions of the conductive members in the forward housing portions, such as by inserting lossy members into slots in the forward housing portion or molding lossy regions into the housing.

In yet other embodiments, the forward housing portion may be formed from front housing portions attached to one or more subassemblies containing conductive members. In affixing the subassemblies side-by-side, the front housing portions align. Lossy material may be incorporated into the connector adjacent making contact portions between the adjacent cap portions, such as by coating sides of the front housing portions or inserting lossy members. For front housing portions that receive two subassemblies, lossy material between cap portions results in lossy material positioned between pairs of columns of conductive numbers.

In yet further embodiments, and contrary to conventional designs, lossy material may be positioned between the broadsides of the pairs of conductive members in a broadside coupled open pin field connector. The lossy material may be formed as a coating on one or both of the conductive members of the pairs or may be incorporated into the connector housing in other ways.

Accordingly, in some embodiments, the invention relates to an electrical connector with an insulative housing. Parallel columns of conductive members are affixed to the insulative housing. Each of the conductive members has a mating interface portion, and lossy members are positioned adjacent the mating interface portions.

In other embodiments, the invention relates to an electrical connector with a plurality of subassemblies. Each of the subassemblies comprises a plurality of conductive members, each of which has a mating contact portion. The mating contact portions of the plurality of subassemblies are arranged in parallel columns. The columns of mating contact portions of the plurality of subassemblies are positioned in a plurality of openings of a housing portion with a plurality of openings also positioned in parallel columns. The housing portion has insulative regions and lossy regions, with the lossy regions positioned to separate pairs of adjacent columns of mating contact portions.

In yet another aspect, the invention relates to an electrical connector with a plurality of broadside coupled pairs of conductive elements. Each of the conductive elements has a mating contact portion, a contact tail and an intermediate portion therebetween. The mating contact portions of the conductive elements of each pair are separated by a first distance and the intermediate portions of the conductive elements of each pair re separated by a second, smaller, distance. The pairs being are positioned in a plurality of parallel rows, and lossy material is selectively positioned adjacent the mating contact portions between adjacent rows.

In yet a further aspect, the invention relates to an electrical connector with a plurality of broadside coupled pairs of conductive elements positioned in a plurality of parallel columns. Each of the pairs includes a first conductive element that has a first broad side and a second conductive element that has a second broad side. The conductive elements are positioned with the first broad side facing the second broad side. Lossy material is coated on at least a portion of at least one of the first broad side or the second broad side.

In yet other aspects, the invention relates to an electrical connector constructed with subassemblies. Each subassembly has first and second wafers and a lossy member. The first wafer has a first plurality of conductive elements. The second wafer has a second plurality of conductive elements. Each of the conductive elements has a broad side, a mating contact portion and a contact tail. The first wafer is attached to the second wafer with the broad sides of the first plurality of conductive elements aligned to form pairs of conductive elements. Within each pair, the broad sides of the conductive elements of the pair are separated by a distance smaller than a distance separating mating contact portions. The lossy member has a plurality of ridges comprising lossy material, which are positioned between adjacent conductive elements.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
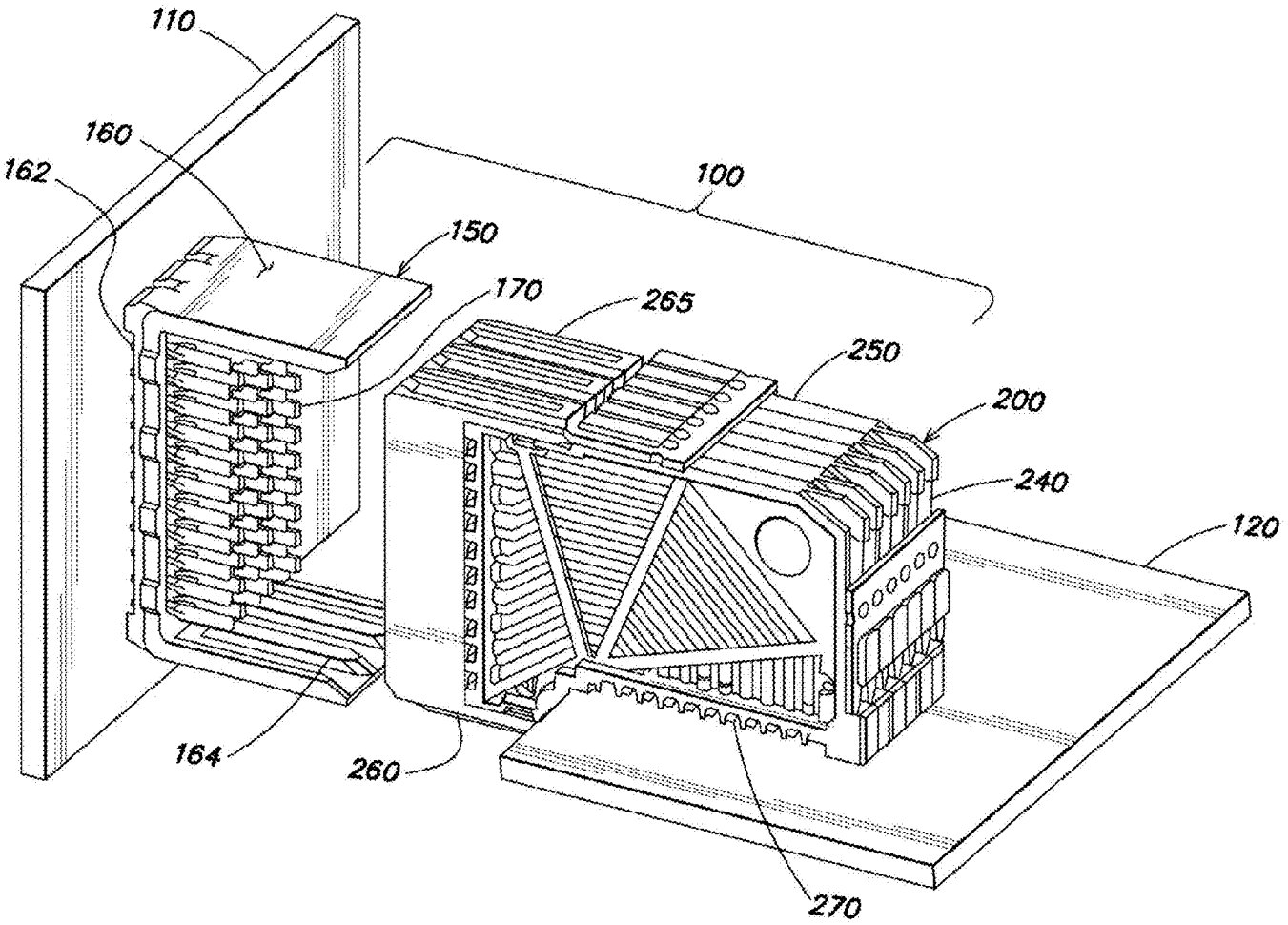
FIG. 1 is a perspective view of a conventional electrical interconnection system comprising a backplane connector and a daughter card connector.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Referring to FIG. 1, a conventional electrical interconnection system 100 is shown. Interconnection system 100 is an example of an interconnector system that may be improved through the selective placement of electrically lossy material, as described below. In the example of FIG. 1, interconnection system 100 joins together PCBs 110 and 120. The electrical interconnection system 100 comprises a backplane connector 150 and a daughter card connector 200, providing a right angle connection.

Daughter card connector 200 is designed to mate with backplane connector 150, creating electrically conducting paths between backplane 110 and daughter card 120. Though not expressly shown, interconnection system 100 may interconnect multiple daughter cards having similar daughter card connectors that mate to similar backplane connectors on backplane 110. Accordingly, the number and type of printed circuit boards or other substrates connected through an interconnection system is not a limitation on the invention.

FIG. 1 shows an interconnection system using a right angle backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter card connector 200 each contains conductive elements. The conductive elements of daughter card connector 200 are coupled to traces, ground planes or other conductive elements within daughter card 120. The traces carry electrical signals and the ground planes provide reference levels for components on daughter card 120. Ground planes may have voltages that are at earth ground or positive or negative with respect to earth ground, as any suitable voltage level may act as a reference level.

Similarly, conductive elements in backplane connector 150 are coupled to traces, ground planes or other conductive elements within backplane 110. When daughter card connector 200 and backplane connector 150 mate, conductive elements in the two connectors mate to complete electrically conductive paths between the conductive elements within backplane 110 and those within daughter card 120.

Backplane connector 150 includes a backplane shroud 160 and a plurality of conductive elements. The conductive elements of backplane connector 150 extend through floor 162 of the backplane shroud 160 with portions both above and below floor 162. Here, the portions of the conductive elements that extend above floor 162 form mating contacts, such as mating contact 170. These mating contacts are adapted to mate with corresponding mating contacts of daughter card connector 200. In the illustrated embodiment, mating contacts 170 are in the form of blades, although other suitable contact configurations may be employed, as the present invention is not limited in this regard.

Tail portions (obscured by backplane 110) of the conductive elements extend below the shroud floor 162 and are adapted to be attached to backplane 110. These tail portions may be in the form of a press fit, "eye of the needle" compliant sections that fit within via holes on backplane 110. However, other configurations are also suitable, such as surface mount elements, spring contacts, solderable pins, etc., as the invention is not limited in this regard.

In the embodiment illustrated, backplane shroud 160 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to some embodiments of the invention. One or more fillers may be included in some or all of the binder material used to form backplane shroud 160 to control the mechanical properties of backplane shroud 160. For example, thermoplastic PPS filled to 30% by volume with glass fiber may be used to form shroud 160. In accordance with some embodiments of the invention, fillers to control the electrical properties of regions of the backplane connector may also be used.

In the embodiment illustrated, backplane connector 150 is manufactured by molding backplane shroud 160 with openings to receive conductive elements. The conductive elements may be shaped with barbs or other retention features that hold the conductive elements in place when inserted in the openings of backplane shroud 160.

The backplane shroud 160 further includes grooves, such as groove 164, that run vertically along an inner surface of the side walls of the backplane shroud 160. These grooves serve to guide front housing 260 of daughter card connector 200 engage projections 265 and into the appropriate position in shroud 160.

In the embodiment illustrated, daughter card connector 200 includes a plurality of wafers, for example, wafer 240. Each wafer comprises a column of conductive elements, which may be used either as signal conductors or as ground conductors. A plurality of ground conductors could be employed within each wafer to reduce crosstalk between signal conductors or to otherwise control the electrical properties of the connector.

However, FIG. 1 illustrates an open pin field connector in which all conductive elements are shaped to carry signals. In the embodiment illustrated, connector 100 includes six wafers each with twelve conductive elements. However these numbers are for illustration only. The number of wafers in daughter card connector and the number of conductive elements in each wafer may be varied as desired.

Wafer 240 may be formed by molding wafer housing 250 around conductive elements that form signal and ground conductors. As with shroud 160 of backplane connector 150, wafer housing 250 may be formed of any suitable material.

In the illustrated embodiment, daughter card connector 200 is a right angle connector and has conductive elements that traverse a right angle. Each conductive element may comprise a mating contact (shown as 280 in FIG. 2A) on one end to form an electrical connection with a mating contact 170 of the backplane connector 150. On the other end, each conductive element may have a contact tail 270 (see also FIG. 2A) that can be electrically connected with conductive elements within daughter card 120. In the embodiment illustrated, contact tail 270 is a press fit "eye of the needle" contact that makes an electrical connection through a via hole in daughter card 140. However, any suitable attachment mechanism may be used instead of or in addition to via holes and press fit contact tails. Each conductive element also has an intermediate portion between the mating contact and the contact tail, and the intermediate portion may be enclosed by or embedded within the wafer housing 250.

The mating contacts of the daughter card connector may be housed in a front housing 260. Front housing 260 may protect mating contacts 280 from mechanical forces that could damage the mating contacts. Front housing 260 may also serve other purposes, such as providing a mechanism to guide the mating contacts 280 of daughter card connector 200 into engagement with mating contact portions of backplane connector 150.

Front housing 260 may have exterior projections, such as projection 265. These projections fit into grooves 164 on the interior of shroud 160 to guide the daughter card connector 200 into an appropriate position. The wafers of daughter card connector 200 may be inserted into front housing 260 such that mating contacts are inserted into and held within cavities in front housing 260 (see also FIG. 4A). The cavities in front housing 260 are positioned so as to allow mating contacts of the backplane connector 150 to enter the cavities in front housing 260 and to form electrical connection with mating contacts of the daughter card connector 120.

The plurality of wafers in daughter card connector 200 may be grouped into pairs in a configuration suitable for use as a differential electrical connector. In this example, the pairs are broadside coupled, with conductive elements in the adjacent wafers aligning broadside to broadside. For instance, in the embodiment shown in FIG. 1, daughter card connector 200 comprises six wafers that may be grouped into three pairs. Though, the number of wafers held in a front housing is not a limitation on the invention. Instead of or in addition to front housing 260 holding six wafers, each pair of wafers may have their own front housing portion (see e.g. FIG. 2B).

Figure 2B:
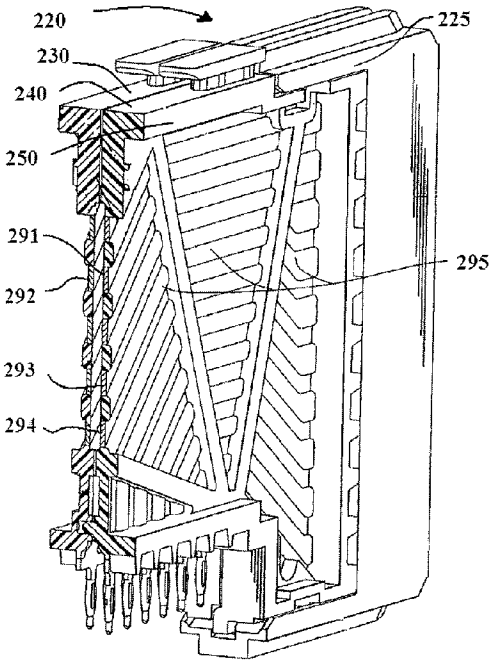
FIG. 2B is a perspective view, partially cut away, of a subassembly of the daughter card connector of FIG. 1.
Figure 2A:
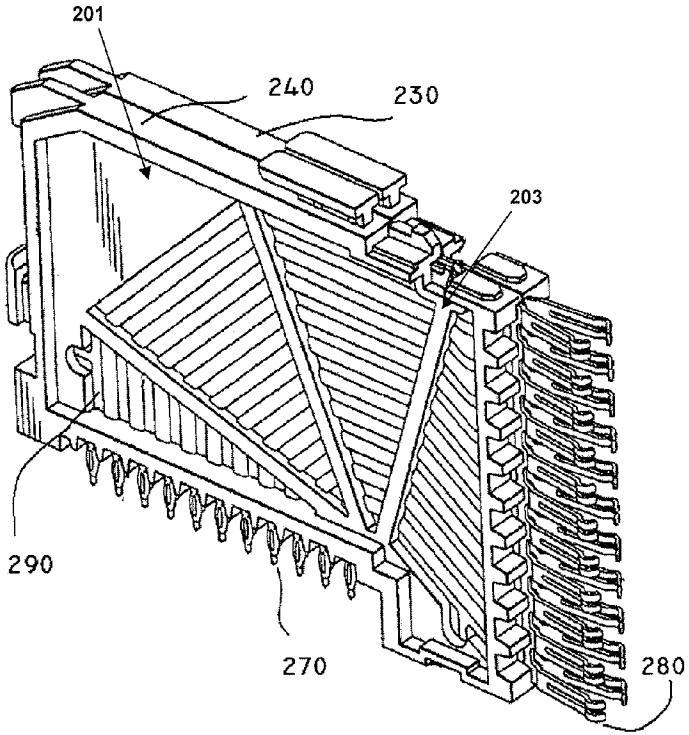
FIG. 2A is a perspective view of two wafers forming a subassembly of the daughter card connector of FIG. 1.

FIG. 2A shows a pair of wafers 230 and 240 coupled together. Any suitable mechanism may be used to mechanically couple the wafers. For example, affixing the wafers in a front housing portion could provide adequate mechanical coupling. However, spacers, snap-fit features or other structures may be used to hold the wafers together and control the spacing between the conductive elements in the wafers.

As illustrated, the conductive elements in these wafers are arranged in such a way that, when these wafers are mechanically coupled together, conductive elements in wafer 230 are electrically broadside coupled with corresponding conductive elements in wafer 240. For instance, conductive element 290 of wafer 240 is broadside coupled with the conductive element in wafer 230 that is located in a corresponding position. Each such pair of conductive elements may be used as ground conductors or differential signal conductors, as the example illustrates an open pin field connector.

Broadside coupling of conductive elements is further illustrated in FIG. 2B, which shows a subassembly with an alternative construction technique for forming a front housing. In the embodiment of FIG. 2B a front housing is created by separate front housing portions attached to pairs of wafers. These components form a subassembly 220, including a front housing portion 225 and two wafers 230 and 240. To form a connector, subassemblies 220 may be positioned side by side to form a connector of a desired length.

In the embodiment of FIG. 2B, front housing portion 225 acts as a front housing for two wafers. To form a connector with six columns as shown in FIG. 1, three subassemblies as pictured in FIG. 2B may be positioned side-by-side and secured with a stiffener or using any other suitable approach. Front housing portion 225 may be molded of any suitable material, such as a material of the type used to make front housing 260. Front housing portion 225 may have exterior dimensions and may have cavities as in front housing 260 to allow electrical and mechanical connections to backplane connector 150, as described above.

In FIG. 2B, portions of wafers 230 and 240 are shown partially cutaway to expose a column of conductive members in each wafer. Wafer 230 comprises conductive elements, of which conductive element 292 is numbered. In wafer 240 conductive elements 291, 293 and 294 are numbered. Conductive elements 291 and 292 are broadside coupled, forming a pair suitable for carrying differential signals. Though not numbered, other conductive elements that align in the parallel columns also form broadside coupled pairs.

In the illustrated embodiment, the space between the elements of a pair of broadside-coupled conductive elements is devoid of filler elements and is instead filled with air. Air has a dielectric constant lower than the dielectric constant of material used to form wafer housing 250. Inclusion of air, because it has a low dielectric constant, promotes tight coupling between the conductive elements forming the pair. Tight coupling is also promoted by shaping the conductive elements so that the conductive elements are physically close together. In the embodiment illustrated, spacing of contact tails and mating contact portions is driven by mechanical considerations. For example, via holes in a printed circuit board that receive contact tails from wafers 230 and 240 must be spaced so that they can be formed without removing so much material in an area of the printed circuit board that the electrical or mechanical properties of the board are degraded. Likewise, the mating contact portions must be adequately spaced so that there is room for compliant motion of at least one of the mating contact portions and to accommodate for misalignment of mating contact portions of the conductive elements in the daughter card on backplane connectors. Thus, though the center spacing of contact tails and mating contact portions within a column and between columns may range, for example, between 1.5 mm and 2.0 mm, the intermediate portions may be spaced by a distance in a range for example, of 0.3 mm to 0.5 mm. To create such a small spacing between the intermediate portions, the intermediate portions of conductive elements in the pair of wafers 230 and 240 may jog towards each other.

The inventors have recognized and appreciated that a problem arises through this tight electrical coupling of broadside pairs in a connector as illustrated in FIGS. 1, 2A and 2B. The problem can be particularly disruptive in an open pin field differential connector in which some pairs are grounded.

Figure 3:
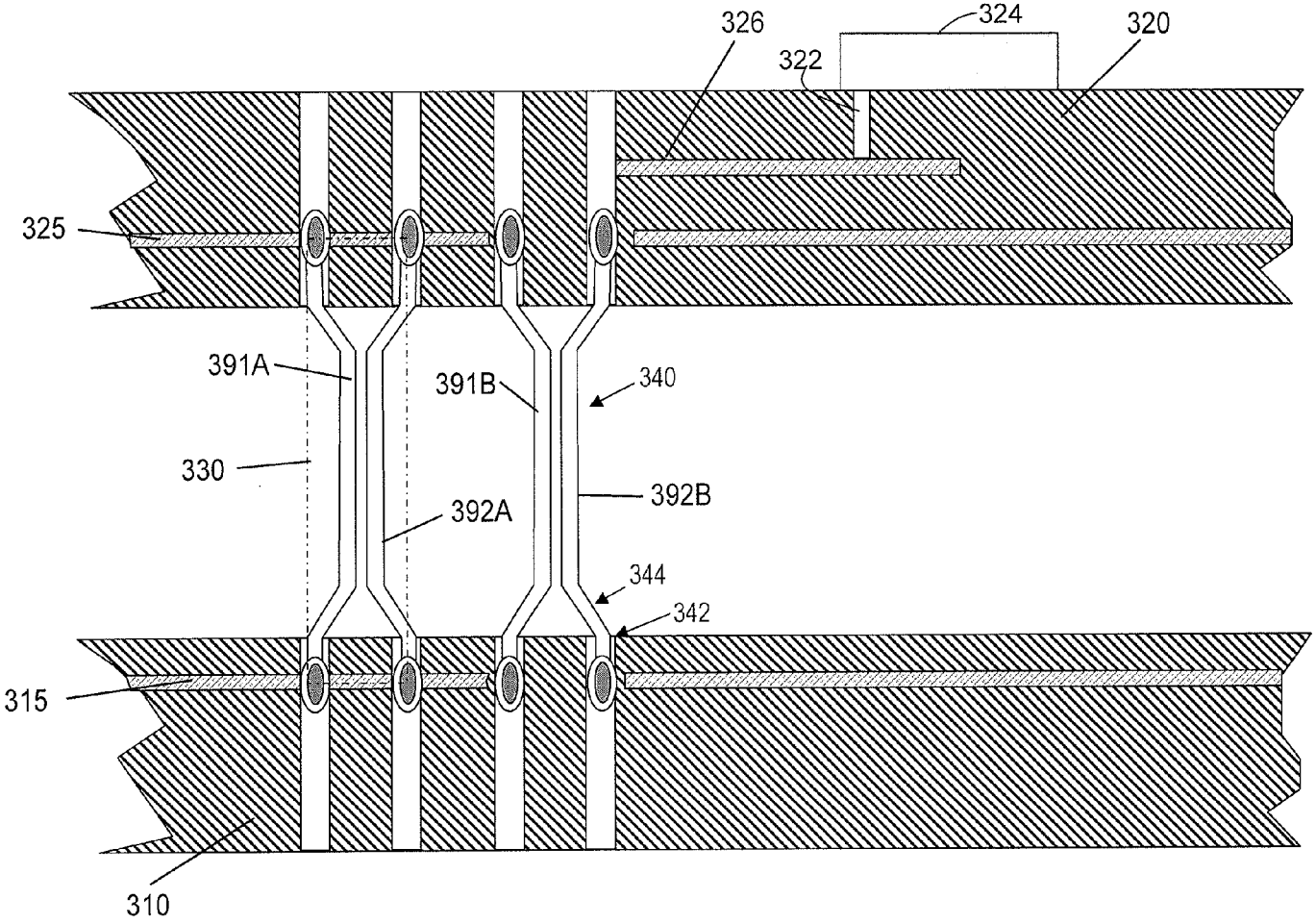
FIG. 3 is a schematic representation of a portion of the electrical interconnection system of FIG. 1, showing conductor pairs mated with two PCBs.

FIG. 3 is a schematic representation of conducting path formed in an interconnection system using an electrical connector as illustrated in FIG. 1, 2A or 2B. Conducting paths 391A and 392A represent a pair of conducting paths formed through mated connectors joining a first printed circuit board 310 to a second printed circuit board 320. In the embodiment illustrated, conducting paths 391B and 392B form a separate pair. As illustrated, each of the pairs is broadside coupled. Such conducting paths, for example, could be formed through an interconnection system such as interconnection system 100.

Each of the conducting paths may include a conductive element within a daughter card connector, which may be mounted to printed circuit board 320, and a conductive element within a backplane connector, which may be mounted to printed circuit board 310. For simplicity, connector housings and mating interfaces between conductive elements are not shown in the schematic representation of FIG. 3. Also, the arrangement of conducting paths as illustrated in FIG. 3 may be created in any suitable way, including through the use of separable connections.

FIG. 3 may be regarded as representing connections formed through an open pin field differential connector. Accordingly, though the conductive elements illustrated are generally all of the same shape, some may be connected to ground and others may be used to carry signals between printed circuit boards 310 and 320. In this example, conductive paths 391B and 392B are connected to carry a signal, which is indicated by a connection to a signal trace 326 within printed circuit board 320. Though only one signal trace 326 is illustrated for simplicity, each of the conducting paths 391B and 392B may be connected to a signal trace within each of printed circuit boards 315 and 325. In contrast, signal paths 391A and 392A are connected to ground. This connection is illustrated by a connection to ground planes 315 and 325 in printed circuit boards 310 and 320, respectively.

FIG. 3 illustrates that the conductive paths between the printed circuit boards 310 and 320 are arranged to provide tightly coupled conductive paths over most of the distance between printed circuit boards 310 and 320. For example, conductive paths 391B and 392B have a tightly coupled region 340 where the spacing between the conductive paths is relatively small. Such conductive paths will propagate a differential mode of a signal with relatively tight coupling. Tight coupling means that the energy of a propagating signal is concentrated predominately between the conductive paths as differential mode components of the signal. However, this tight coupling may not be maintained fully over the length of the conductive paths. For example, where the conductive paths are attached to a printed circuit board or where a mating interface is to occur, the conductive members that form the conductive path may be more widely spaced. Accordingly, relatively widely spaced region 342 is illustrated along the conductive paths 391B and 392B. In this region, the conductive paths are more loosely coupled and more readily support propagation of common mode signal components. Between the tightly coupled regions 340 and the loosely coupled region 342, a transition region 344 may be present. While not being bound by any particular theory, the inventors have recognized and appreciated that grounding both ends of a tightly coupled pair of conductive paths, such as 391A and 392A, and creates a structure that is electrically similar to a closed cavity. The cavity-like structure created by connecting conductive paths 391A and 392A to ground planes 315 and 325 is represented schematically as cavity 330. Because of the tight coupling between signal paths 391A and 392A, cavity 330 has a high Q, meaning that the cavity 330 will have a pronounced resonant frequency and electrical energy exciting cavity 330 near that resonant frequency will produce a relatively large oscillation of electrical energy within cavity 330.

The inventors have recognized and appreciated that a connector as illustrated in FIGS. 1, 2A and 2B with spacing between columns and between conductive elements within a column of approximately 2 mm or less results in the formation of cavity-like structures, illustrated schematically as cavity 330, that have resonant frequencies between about 1 and 10 GHz. The inventors have also recognized and appreciated that signals used in modern electronic systems have substantial frequency components in frequency ranges that include the resonant frequency of cavity-like structures formed by grounding tightly coupled pairs as illustrated in FIG. 3.

For example, an electronic component, such as component 324, coupled to signal trace 326 through a via 322 may output such a signal that excites resonances. Signals that may be passing through the connector have the potential to excite resonances within the cavity-like structures formed by grounding a tightly coupled pair. Because of the high Q of the cavity-like structures, the resonances excited inside cavity 330 can be larger than the energy that excited the resonance. As a result, the resonant signals can have a relatively large impact on pair 391B and 392B and other surrounding pairs. Coupling of a resonant signal from a cavity-like structure to surrounding pairs will appear as crosstalk on pairs of conductive elements used to carry signals.

The inventors have also recognized that the amount of resonance, and therefore the amount of crosstalk, may be increased if the conducting paths have widely spaced regions, such as region 342. Though tightly coupled differential pairs are theoretically relatively immune to incident noise because an incident signal affects each leg of the pair similarly, the structure illustrated in FIG. 3 has an unexpected sensitivity. The sensitivity can result from the relatively widely spaced regions 342 of the conductive paths, such as occur where a connector is attached to a printed circuit board or where conductive elements of two connectors mate, support a common mode signal. These segments are relatively susceptible to incident noise.

Further, the transition 344 from widely spaced to closely spaced conductive elements can cause mode conversion. Common mode signals from the widely spaced regions may give rise to differential mode components signals within the tightly coupled regions, which in turn support resonance. Conversely, resonating differential mode components in the tightly coupled regions 340 may be converted to common mode components in the widely spaced regions. These common mode components may be more readily coupled to widely spaced regions of adjacent pairs. When coupled from a grounded, resonating pair to an adjacent pair, this coupled energy appears as crosstalk that impacts performance of the connector. When coupled from an adjacent pair to a grounded pair, this energy may excite resonance.

The inventors have recognized and appreciated that selective placement of lossy material within the connector may improve the overall performance of the connector, even if it is not known which of the pairs of conductive elements will be connected to ground during operation of the connector.

Multiple approaches are possible for the placement of lossy material. In some embodiments, lossy material may be positioned to reduce the amount of energy coupled to a pair of conductors that has been grounded, which therefore reduces the amount of energy coupled to a cavity-like structure. Consequently, less energy reaches the pair to excite resonance. A second approach is to place lossy materials at any convenient location along the conductive elements in positions that reduce the propensity of a cavity-like structure to support resonance. For pairs of conductors that are grounded, this lossy material will have the effect of reducing the Q of the cavity-like structure formed when the pair of conductive elements is grounded. As a result, the resonances created within the cavity-like structure will be damped. Because there is less resonance, substantially less crosstalk interference may be generated on adjacent pairs of conductive elements being used to carry signals.

In an open pin field connector in which pairs are not designated to carry signals or grounds, the lossy material may have the same position relative to all pairs. For pairs used to carry signals, the lossy material may cause a loss of signal energy. However, the inventors have recognized and appreciated that, through the selective placement of lossy material the effect of reducing the undesirable resonances out weighs the effect of reducing signal energy. For example, a pair of conductive elements may form a cavity-like structure with a Q of 1,000 when the conductive elements are grounded without any lossy material. By incorporating lossy material that would attenuate a signal propagating along those conductive elements by 10%, the Q of the cavity-like structure formed by grounding that pair may be reduced from 1,000 to 10. A corresponding 100-fold decrease in resonance may result. Accordingly, the lossy material, though it impacts conductive elements used to carry signals as well as those that are grounded, has a far greater impact in reducing the resonances supported in conductive elements that are grounded than on the signals carried by those conductive elements. As a result, incorporating lossy material adjacent a portion of each pair of conductive elements can overall provide an increase in connector performance.

Any suitable lossy material may be used. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz. or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter. In some embodiments material with a bulk conductivity of between about 25 siemans/meter and about 500 siemans/meter may be used. As a specific example, material with a conductivity of about 50 siemans/meter may be used.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in filler element 295 may be disposed generally evenly throughout, rendering a conductivity of filler element 195 generally constant. An other embodiments, a first region of filler element 295 may be more conductive than a second region of filler element 295 so that the conductivity, and therefore amount of loss within filler element 295 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

Regardless of the specific lossy material used, one approach to reducing the coupling between adjacent pairs is to include lossy material in each wafer between the intermediate portions of conductive elements that are part of separate pairs. Such an approach may reduce the amount of energy coupled to grounded pairs and therefore reduce the magnitude of any resonance induced. In the embodiment of FIG. 2B, filler element 295 occupies space between conductive elements in a column that are part of separate pairs. To incorporate lossy material between pairs, filler elements 295 may contain lossy material. For example, filler elements 295 may be made from a thermoplastic material that contains conducting particles or other lossy material. This configuration may reduce coupling between adjacent broadside coupled pairs. To prevent the lossy material from shorting conductive elements, such as conductive elements 293 and 294, a combination of lossy dielectric materials and lossy conductive materials may be used.

Figure 4B:
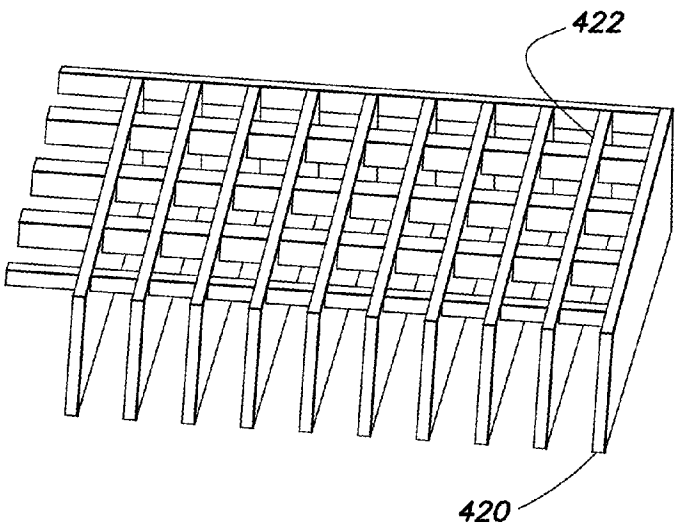
FIG. 4B is a side view of the front housing of FIG. 4A, emphasizing regions of lossy material with insulative portions shown in phantom.
Figure 4A:
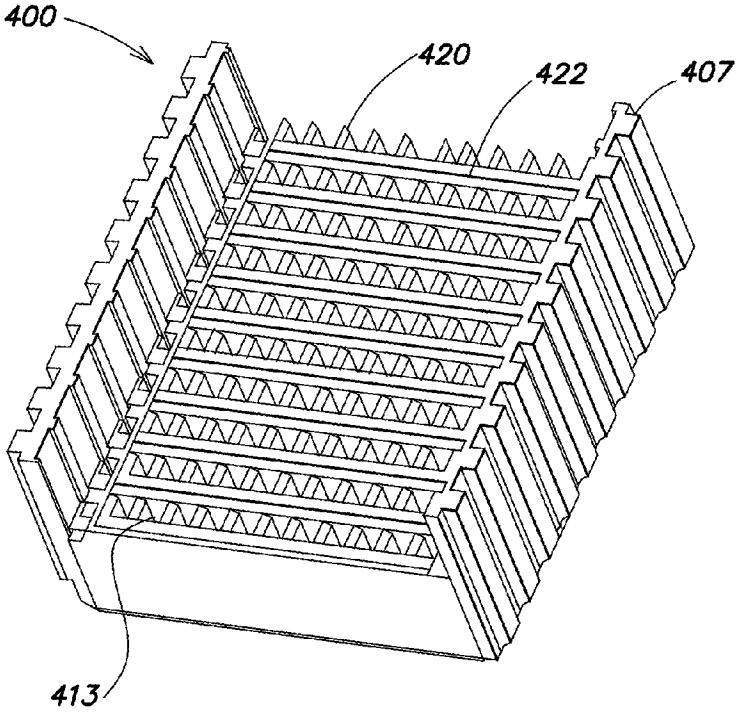
FIG. 4A is a perspective view of a front housing that may be used to improve performance of the daughter card connector of FIG. 1.

FIG. 4A illustrates an alternative approach for selectively positioning lossy material in which lossy material is selectively positioned in a connector to dampen resonance within a cavity-like structure that may be formed by grounding a pair of conductive elements. An improvement in signal to noise ratio in the connector can be achieved by selectively placing lossy material adjacent pairs of conductive elements even if not positioned to fully shield the adjacent pairs. The lossy material may be placed in the vicinity of a portion of the conductive elements of a pair where mode conversion can occur and also where common mode signals propagate. The material may also be placed where energy is loosely coupled between adjacent conductors. As described above, for a connector as pictured in FIGS. 1, 2A and 2B, mode conversion may occur near the mating interface of the daughter card connector or near the mounting surface of the daughter card connector. Because of the wider spacing of the mating contact portions and contact tails relative to the intermediate portions of the conductive elements, these regions also more readily support common mode signals and have loose coupling, making these locations suitable for selective positioning of lossy material.

FIG. 4A illustrates an embodiment in which lossy material is selectively placed adjacent pairs of conductive elements in the vicinity of the mating interfaces. As illustrated in FIG. 1, the mating interface occurs within a front housing 260. Accordingly, a connector according to some embodiments of the invention may be constructed by incorporating lossy material into a front housing portion for a daughter card connector.

FIG. 4A shows a perspective view of a front housing 400 similar to front housing 260 of FIG. 1, with the addition of lossy material. All other components of interconnection system 100 (FIG. 1) may be used with such a housing, creating the possibility of a connector platform in which performance can be tailored by changing just a front housing portion.

Front housing 400 comprises side walls 407 and a plurality of cavities 413. Each of cavities 413 may receive a mating contact of a conductive element of the daughter card connector, e.g., mating contact 280 in FIG. 2A. When mating to another connector, a mating contact portion of a conductive element of the mating connector may enter the cavity, thereby completing the electrical connection between conductive elements within the cavity. By including lossy material in the walls that define the cavity, the lossy material is positioned near the mating contact regions. Lossy material may be introduced in front housing 400 in any suitable way, such as by molding electrically lossy material and insulative material in a two shot molding operation to form an integral housing having insulative and lossy segments.

FIG. 4B is a side view of the front housing of FIG. 4A, emphasizing lossy segments. Various positions of the lossy regions are possible according to various embodiments of the invention. In the embodiment illustrated, the lossy material is in generally planar regions that run parallel to columns of conductive elements. In some embodiments, the planar regions may be positioned between paired columns of mating contact portions such that a planar lossy region is positioned between every two columns.

Such a structure may be formed by making the insulative portions first and subsequently molding the lossy regions. In the illustrated embodiment, side walls 407 are formed with insulative material. Some internal surfaces within each of cavities 413 may be lined with insulative material. For instance, insulative lining may be desirable for surfaces with which conductive elements may come into contact. Of course, the invention is not limited in this respect, as other suitable operations may be used to form a front housing comprising electrically lossy material. Further, the front housing may comprise a unitary lossy segment, or multiple lossy segments that are manufactured separately and later assembled together.

In some embodiments, electrically lossy segments may be positioned so that they occupy some space between mating contacts in the same column. For instance, lossy segment 422 runs perpendicular to the columns of mating contacts and separates mating contacts associated with differential signal conductors in different pairs. As shown in FIG. 4B, lossy segment 422 does not extend to the bottom of front housing 400, whereas lossy segment 420 does. Of course, the invention is not limited in this respect, and each lossy segment may extend towards the bottom of front housing 400 to a lesser or greater extent.

Any suitable amount and extent of lossy material may be incorporated in front housing 400, which may be determined based on the desired level of crosstalk reduction. Consideration may also be taken based on the amount of signal attenuation that may result from the presence of lossy material in front housing 400. As described above, positioning lossy material in the vicinity of a point where mode conversion occurs may increase the effectiveness of the lossy material. In a connector using a front housing as in FIG. 4A, mode conversion may occur where the spacing between conductive elements of a pair increases as the conductive elements enter the front housing. Accordingly, it may be desirable to extend the lossy regions as illustrated in FIG. 5.

Figure 5:
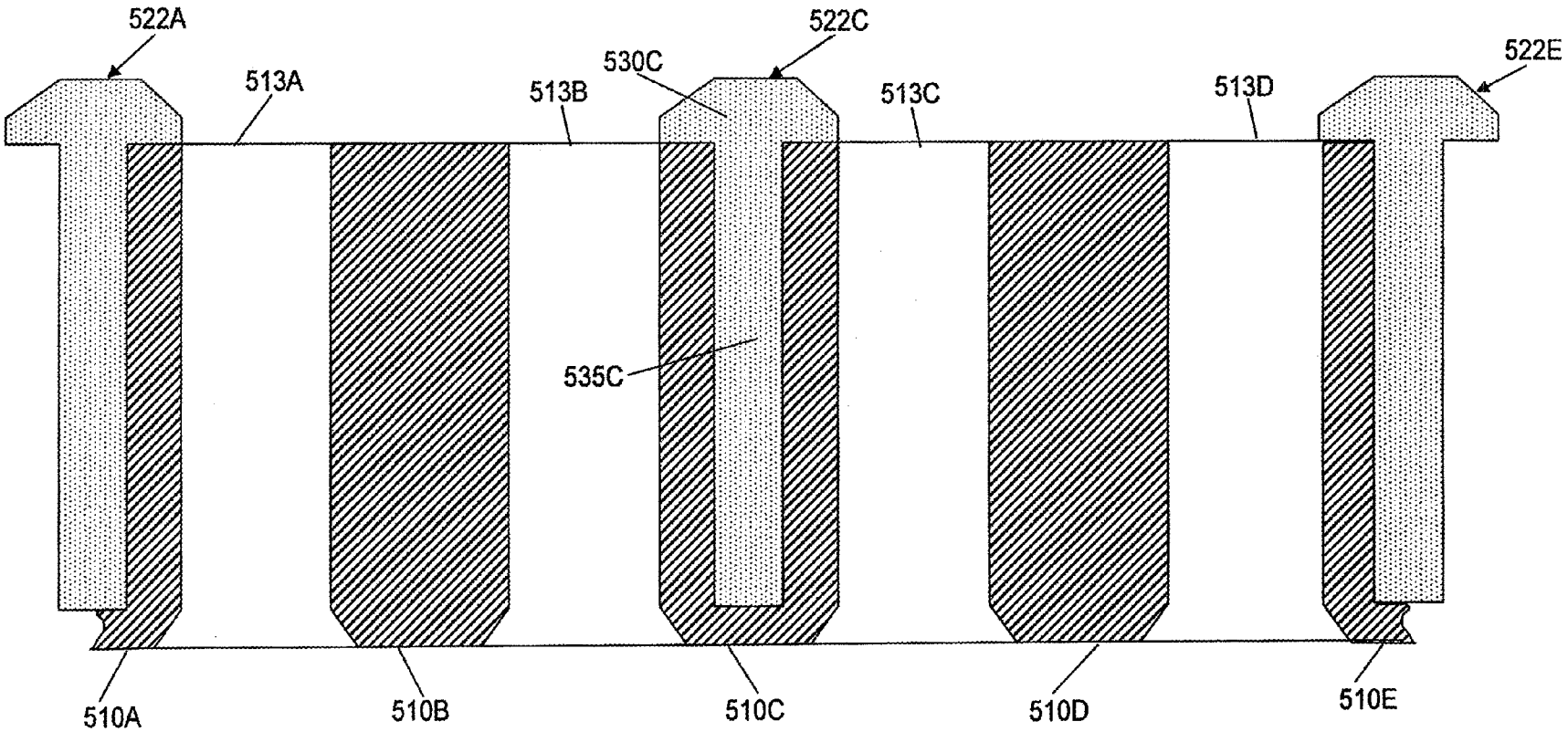
FIG. 5 is a cross-sectional view of a front housing of a daughter card connector according to some embodiments of the invention, showing a plurality of cavities for receiving mating contact portions of mating daughter card and backplane connectors with a plurality of lossy segments disposed between adjacent pairs.

FIG. 5 is a cross-sectional view of a front housing of a daughter card connector according to some embodiments of the invention, showing a plurality of internal walls 510A-E separating cavities 513A-D. Cavities 513A-D are configured to receive mating contacts of conductive elements when the front housing is fitted onto one or more wafers of the daughter card connector. Portions of internal walls 510A-E that may come into contact with mating contacts may be formed or lined with insulative material. In the illustrated embodiment, some of the internal walls, i.e., 510A, 510C, and 510E, each comprise a slot to receive a lossy segment. Lossy segments 522A, 522C, and 522E are formed within slots in internal walls 510A, 510C, and 510E. The lossy segments may be formed by a two shot molding operation or may be formed as separate members that are inserted into slots. Though, any suitable manufacturing techniques may be used.

In the illustrated embodiment, each of lossy segments 522A, 522C, and 522E comprises a planar portion and a cap portion. For instance, lossy segment 522C comprises planar portion 530C and cap portion 535C. Planar portion 530C is disposed within the slot in internal wall 510C, while cap portion 535C extends above internal wall 510C.

Cavities 513A and 513B are configured to receive mating contacts of a pair of conductive elements, which may be broadside coupled. In the embodiment illustrated, all conductive elements will be similarly shaped and any pair may be used as ground conductors or as differential signal conductors. In the embodiments of FIG. 5, no lossy segments are disposed within internal wall 510B, which separates cavities 513A and 513B. These cavities may each receive a mating contact portion of the two conductive elements that form one pair. Likewise, cavities 513C and 513D are configured to receive mating contacts of another pair of conductive elements, and no lossy segments are disposed within internal wall 510D.

Figure 6:
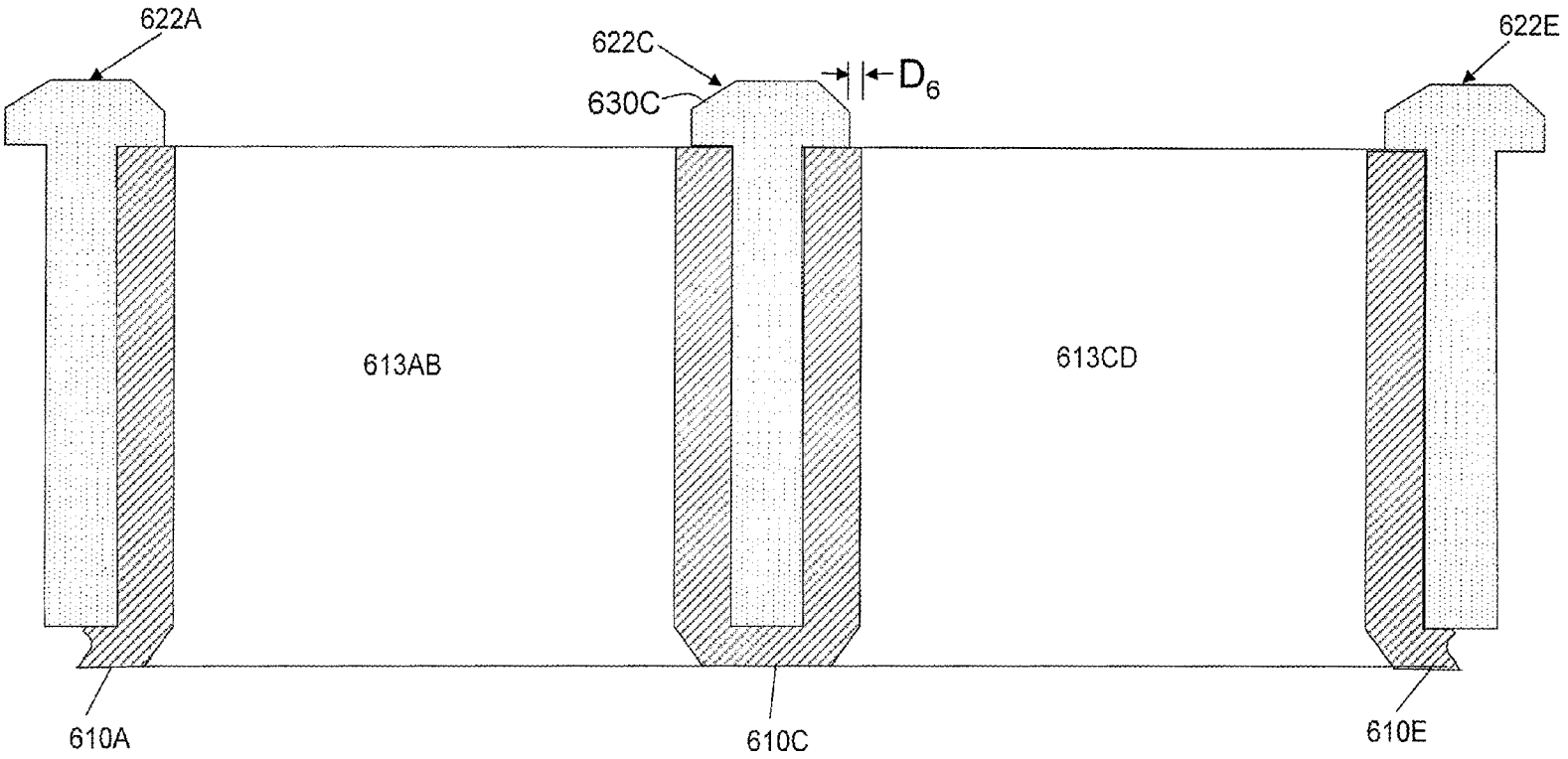
FIG. 6 is a cross-sectional view of a front housing of a daughter card connector according to some alternative embodiments of the invention, showing a plurality of cavities for receiving mating contact portions of mating daughter card and backplane connectors with a plurality of lossy segments disposed between adjacent pairs.

In some alternative embodiments, internal walls 510B and 510D may be diminished in size or omitted entirely. Such a configuration may reduce the effective dielectric constant of material between conductive elements that form a differential pair and increasing coupling. One such embodiment is illustrated in FIG. 6. A larger cavity 613 is formed, in place of two smaller cavities separated by an internal wall, and is configured to receive both mating contacts of a pair of broadside-coupled conductive elements.

FIG. 6 also illustrates that a cap portion of a lossy member, of which cap 630C is numbered, may be formed to be narrower than an insulative wall into which the lossy member is incorporated. As a result, there is a setback $D_6$ between the lossy member and the insulative wall. Such a setback may reduce the possibility that conductive members within the insulative housing contact the lossy members. As in other embodiments, the lossy member may be incorporated into the housing in any suitable way, including as part of a two-shot molding operation or by insertion of a separately formed member into a slot in the housing.

Figure 7:
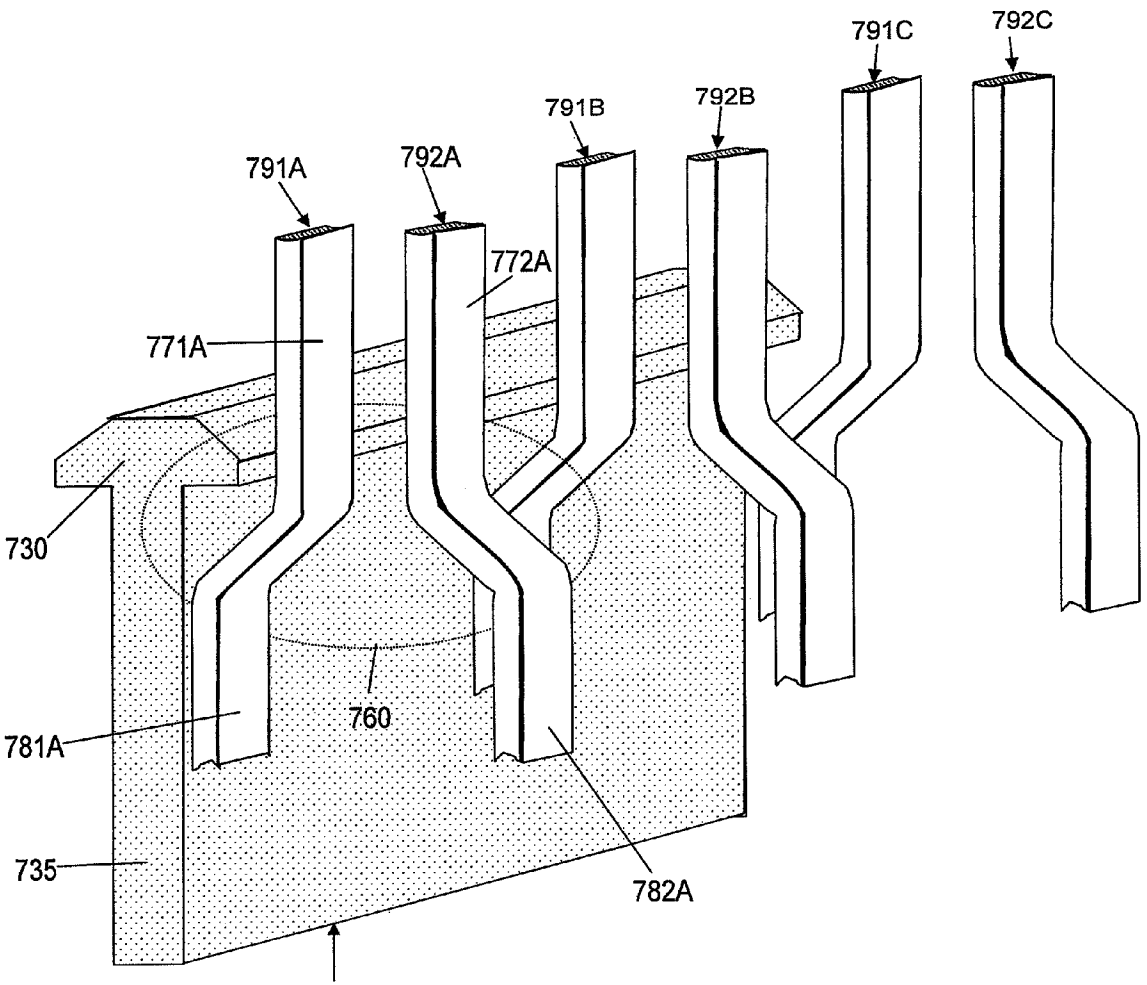
FIG. 7 is a perspective view of two columns of conductive elements disposed alongside a lossy segment, forming a portion of a daughter card connector according to some embodiments of the invention.

Internal walls and lossy segments may have substantial length in the dimension not visible in the cross sections of FIGS. 5 and 6. In some embodiments of the invention, an internal wall and the associated lossy segment may run along an entire column of broadside-coupled pairs of conductive elements. FIG. 7 illustrates such an arrangement, with insulative walls omitted to show more clearly the relative positioning of a lossy segment with respective to the conductive elements.

As shown in FIG. 7, conductive element 791A and conductive element 792A are broadside coupled. Conductive element 791A has an intermediate portion 771A and a mating contact 781A, and conductive element 792A has an intermediate portion 772A and a mating contact 782A. In this example, the conductive elements form a tightly coupled pair and the distance between intermediate portions 771A and 772A is smaller than the distance between mating contacts 781A and 782A (see also $D_1$ and $D_2$ in FIG. 8). It is theorized that mode conversion may occur in the area indicated by circle 760, where the spacing between conductive elements in a pair changes. Even though differential pairs carrying signals are tightly coupled over their intermediate portions and do not readily propagate common mode signals, if mode conversion occurs, common mode signals within the mating contact regions, contact tail regions or other regions where the conductive elements are not tightly coupled may nonetheless excite resonances in the intermediate portions.

To reduce noise potentially caused by these resonances, lossy material may be placed near an area where mode conversion is likely to occur. In the embodiment illustrated in FIG. 7, the cap portion 730 of lossy segment 722 is significantly wider than the planar portion 735. As a result, more lossy material is placed in the proximity of the circled area 760, where mode conversion is likely to occur as signals transit between the mating contacts and the intermediate portions of the conductive elements. This placement of lossy material may reduce differential mode noise and/or crosstalk between adjacent pairs of differential signal conductors, thereby improving signal quality. This placement of lossy material may be effective at reducing crosstalk, even through the area between the intermediate portions is substantially free of lossy material.

Figure 8:
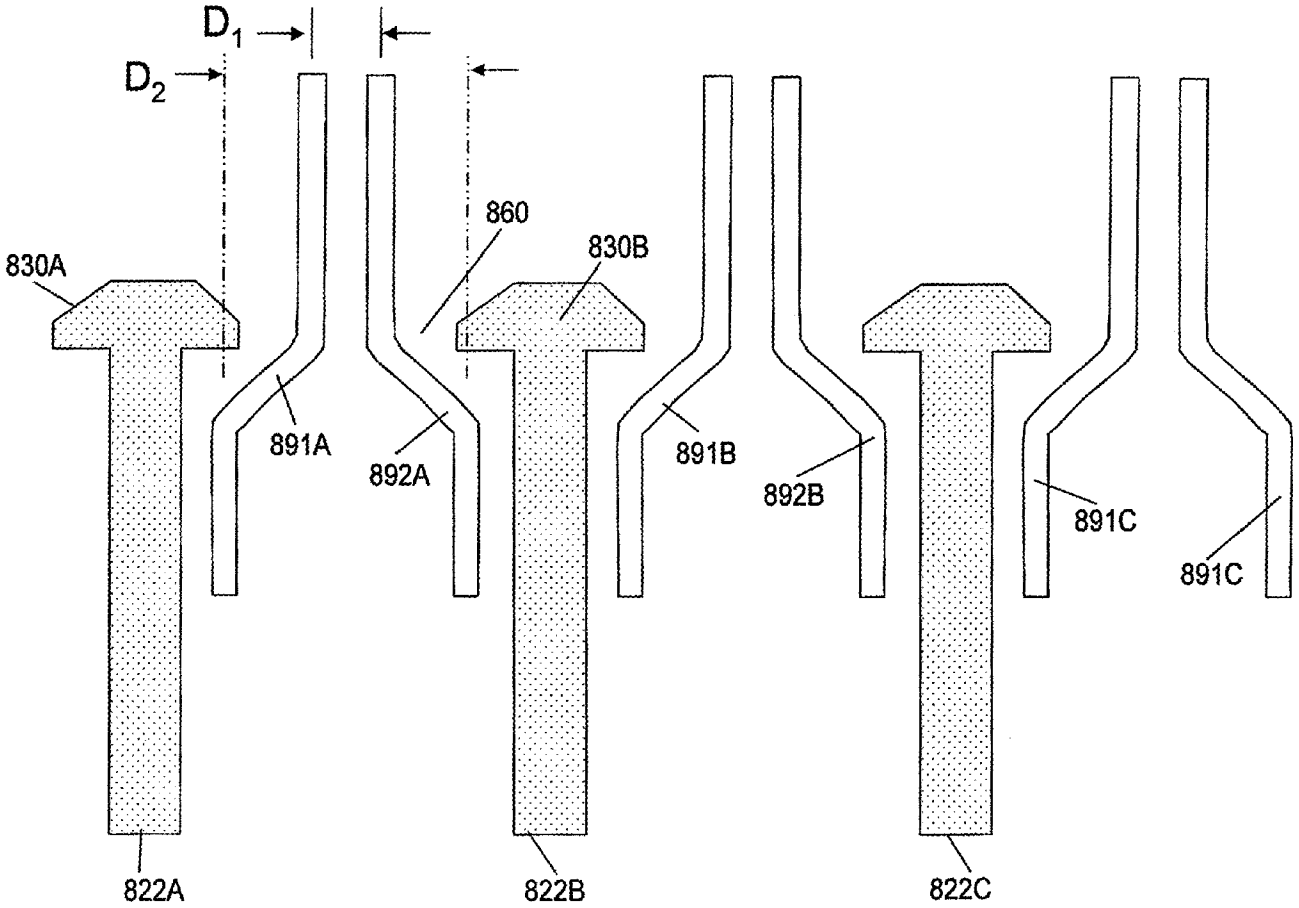
FIG. 8 is a cross-sectional view of a portion of a daughter card connector according to some embodiments of the invention, showing pairs of conductive elements disposed among a plurality of lossy segments.

FIG. 8 is a cross-sectional view of a forward portion of a daughter card connector according to some embodiments of the invention, showing pairs of conductive elements and a plurality of lossy segments at the mating interface. While FIG. 7 shows a view along columns of conductive elements, FIG. 8 shows a view cutting across columns of conductive elements. Here, the mating contact portions are shown schematically for simplicity, but could be shaped as single beams, dual beams, forks or in any other suitable form. Internal walls and/or other supporting structures are omitted from this view to show more clearly the relative positioning of lossy segments with respective to broadside-coupled pairs of conductive elements. For example, conductive elements 891A and 892A are broadside coupled and are placed between lossy segments 822A and 822B. Distance $D_1$ is the distance between the intermediate portions of conductive elements 891A and 892A, and distance $D_2$ is the distance between the mating contacts of conductive elements 891A and 892A. In the illustrated embodiment, distance D1 is smaller than distance D2.

$D_1$ may, for example, be less than 1 mm, while $D_2$ may be greater than 1.5 mm. As a specific example, intermediate portions of conductive elements in a pair may have a center to center spacing of 0.4 mm while mating contact portions may have a center to center spacing of 1.85 mm or 2 mm. As shown, the distance between conductive elements 891A and 892A changes in region 860, and it is theorized that differential mode resonance may be excited in this area due to mode conversion of common mode signals coupled to the portions of conductive elements separated by a distance $D_2$.

Lossy segments 822A and 822B comprise cap portions 830A and 830B, respectively, so that lossy material is placed in the proximity of region 860. With the configuration illustrated in FIG. 8, lossy material is placed in the vicinity of the portions of conductive elements where coupling between the conductive elements of a pair is weakest. As illustrated, the weakest coupling occurs where the spacing is $D_2$, adjacent lossy segments 822A . . . 822C. Accordingly, the lossy regions can be most effective at damping resonances within any pair that is grounded. Moreover, the configuration of FIG. 8 results in lossy material positioned in regions where mode conversion may occur, thereby reducing the amount of resonance induced by a common mode signal.

A third possibility for the selective placement of lossy material is to incorporate the lossy material between the conductive members of a pair. Though placing lossy material between the conductive members of a pair will reduce the signal energy propagated by any pair connected to signal traces in the printed circuit boards, the tight coupling between the conductive elements means that there is a large amount of signal energy concentrated between the conductive elements of a pair, such that the attenuation caused by a small amount of lossy material between the conductive elements does not disrupt transmission of a signal. However, for pairs of conductive elements that are grounded, the lossy material between the conductive elements of the pair causes a substantial decrease in the Q of a cavity-like structure formed when the pair is grounded. Because the magnitude of the resonant energy within a cavity-like structure increases in proportion to the Q of the cavity and because the amount of crosstalk generated is proportional to the magnitude of the resonant energy, decreasing the Q of the cavity-like structure can have a significant impact on crosstalk generated within the connector. In some embodiments, the reduction in crosstalk by incorporating lossy material between the conductive elements of the pairs results in improved signal to noise ratio in the connector even though the signal energy is also attenuated.

Figure 9:
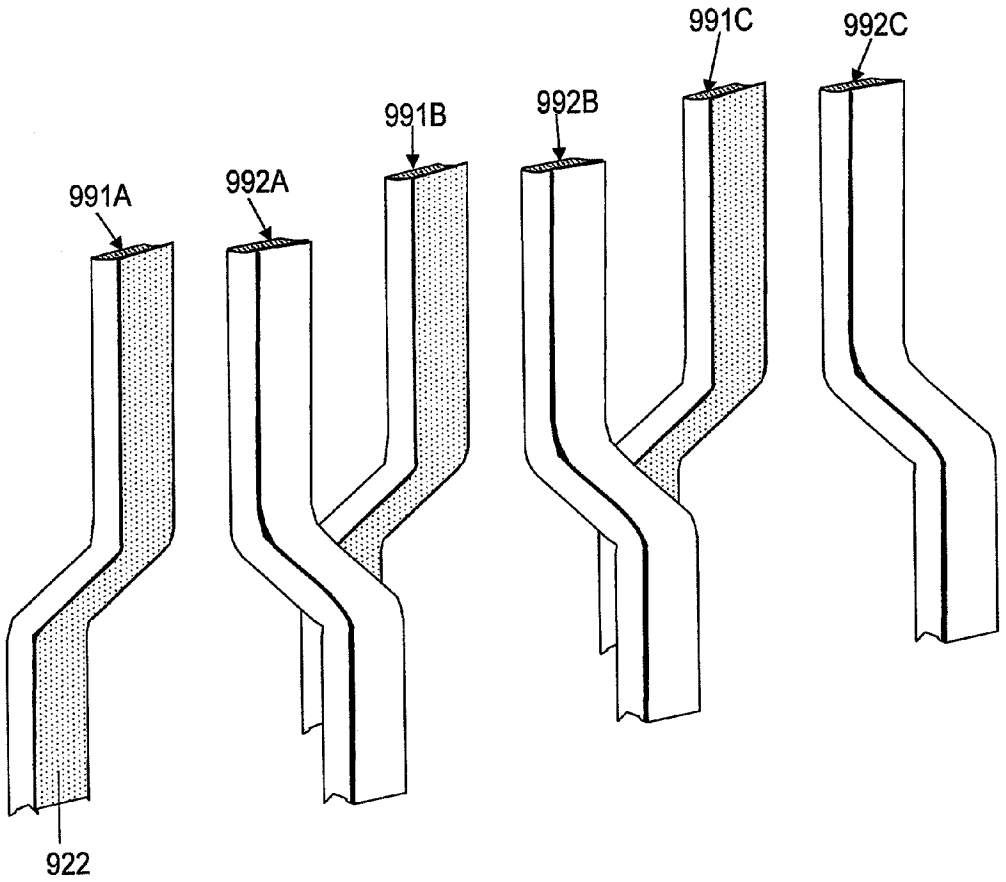
FIG. 9 is a perspective view of a column of pairs of conductive elements forming a portion of a daughter card connector according to some embodiments of the invention in which a lossy coating is applied to some surfaces of the conductive elements of a pair of conductive elements.

FIG. 9 is a perspective view of two columns of conductive elements forming a portion of a daughter card connector according to some alternative embodiments of the invention. Each conductive element in one of the two columns is broadside coupled with a conductive element in the other column at the corresponding location. For example, conductive element 991A is broadside coupled with conductive element 992A. In the illustrated embodiment, a coating 922 of lossy material is applied to some of the conductive elements, such as conductive element 991A. In an open pin field connector, the lossy material may be applied between conductive elements of each pair. The lossy coating may be applied to each element. Though, in some embodiments, the lossy coating may be applied to only one conductive element of each pair.

In the case of lossy coating 922 applied to conductive element 991A, lossy coating 922 is applied to conductive element 991A on a surface that faces conductive element 992A, such that lossy coating 922 forms effectively a lossy segment between conductive elements 991A and 992A. The thickness of lossy coating 922 may be chosen to reduce unwanted resonances for a pair used as a ground conductor without excessive attenuation of signals carried by conductive elements 991A and 992A if used as signal conductors.

While FIG. 9 illustrates a thin and contiguous lossy coating, any suitable thickness and arrangement may be used, as the invention is not limited in these respects. For example, the lossy material may be coated on conductive elements only along the intermediate portions of the conductive elements where the conductive elements are close together. Alternatively, in some embodiments, the lossy coating may be applied only in transition regions where mode conversion may occur as described above. As a further alternative, the lossy coating may be applied only in regions outside of the tightly coupled segments, such as in the vicinity of mating contact portions. Though, lossy material may be applied to any combination of areas and the extent of the lossy coating may be selected to reduce resonances to an acceptable level for pairs that are connected to ground without causing an unacceptable attenuation of signals for pairs used to transmit signals.

This physical extent of the conductive elements coated may depend on the loss properties of the coating. The loss properties may depend both upon the materials used to form the lossy coatings as well as its thickness. Accordingly, in some embodiments, the thickness, placement and extent of the coating may be determined empirically.

The lossy coating may be applied in any suitable way. For example, lossy filler may be incorporated into a paint, epoxy or other suitable binder and applied as a thin film over the surfaces of the conductive elements in regions where the lossy coating is desired. As another example, a lossy coating may be formed as a tape or film and then applied to the surfaces of the conductive elements. Though not visible in FIG. 9, the lossy coating may be applied to both conductive elements in a pair. For example, conductive elements 992A, 992B and 992C may contain a lossy coating similar to the coating 922 on conductive elements 991A, 991B and 991C. Coating both conductive elements is one approach to increasing the amount of loss.

Figure 10B:
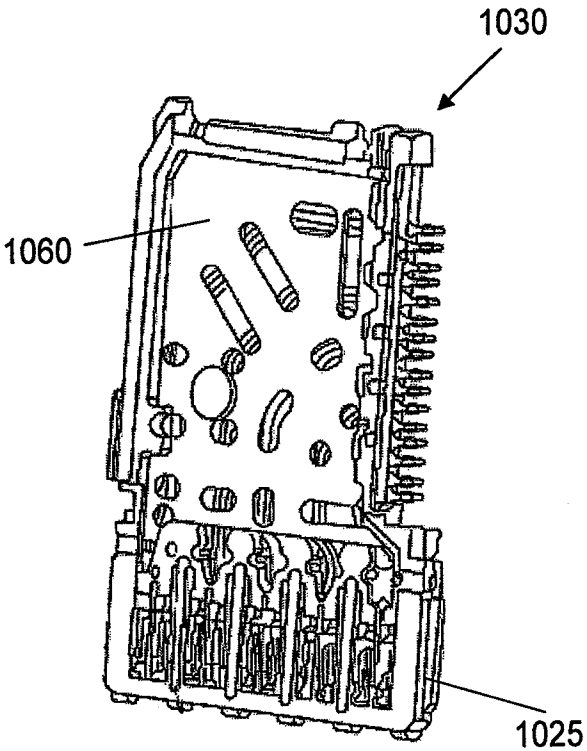
FIG. 10B is a front view of the wafer of FIG. 10A, with lossy segments inserted into the plurality of slots.

The foregoing embodiments provide examples of techniques for selectively incorporating lossy material within a connector. Other embodiments are possible. For example, FIGS. 10A and 10B illustrate an alternative approach to incorporating lossy material in the vicinity of mating contact portions of a daughter card.

Figure 10A:
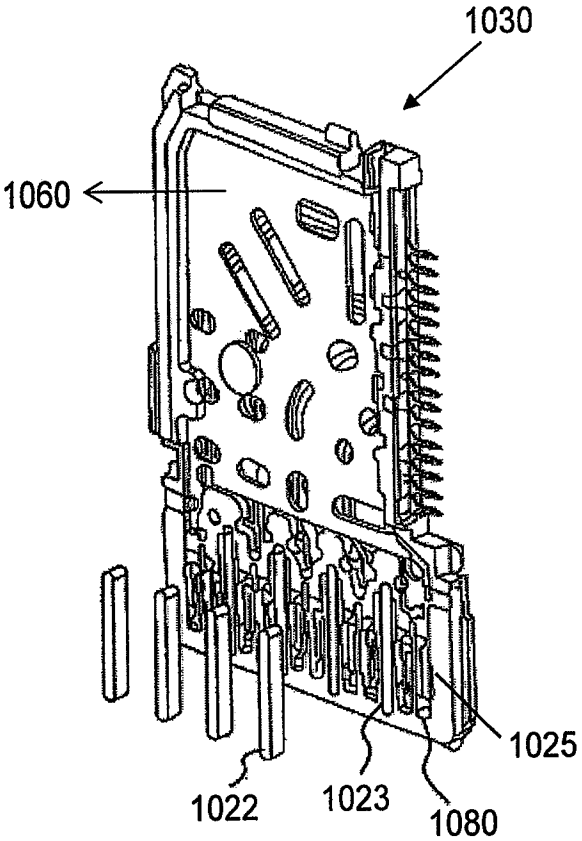
FIG. 10A is a perspective view of a wafer forming a portion of a daughter card connector according to some embodiments of the invention, in which a front housing includes a plurality of slots to receive lossy segments.

FIG. 10A is a perspective view of a wafer 1030 forming a portion of a daughter card connector according to some embodiments of the invention. Mating contacts of wafer 1030, such as mating contact 1080, are housed is a front housing portion 1025. Front housing 1025 may be an integral part of wafer housing 1060 or a separate component to be assembled with wafer housing 1060. Similar to mating contacts shown in FIG. 2A, mating contacts of wafer 1030 are configured to form electrical connections with mating contacts of a backplane connector. When the backplane connector and the daughter card connector mate, front housing portion 1025 may slide into a shroud of the backplane connector (e.g., shroud 160 shown in FIG. 1), allowing some mating contacts of the backplane connector to form the desired electrical connections with mating contacts of wafer 1030.

Front housing portion 1025 may comprise one or more slots, such as slot 1023, configured to receive one or more lossy segments, such as lossy segment 1022. FIG. 10B is a front view of the wafer of FIG. 10A, showing a plurality of lossy segments each inserted into a slot in front housing portion 1025. The size or locations of such slots in front housing portion 1025 may be chosen so that noise and/or crosstalk are reduced due to the presence of lossy material. As in embodiments described above, lossy segments may be formed as separate members and inserted into slots 1023 or may be molded in slots 1023.

For a broadside coupled connector in which pairs are formed by coupling conductive elements in adjacent wafers, lossy segments may be positioned between the mating contact portions of all conductive elements within a column. For an edge coupled connector in which adjacent conductive elements in a column form a pair, the lossy segments may be positioned between every pair of conductive elements in a column.

Figure 11:
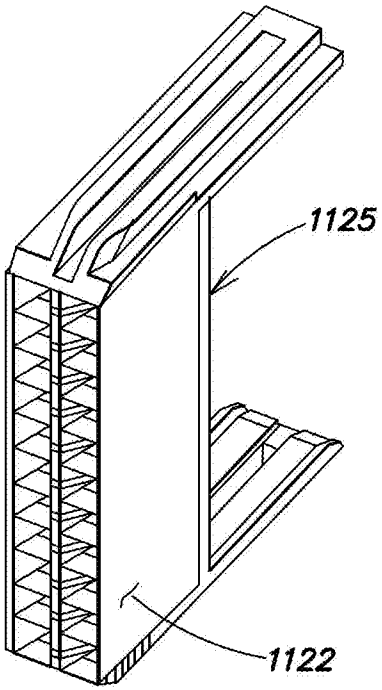
FIG. 11 is a perspective view of a front housing according to some embodiments of the invention in which a lossy coating is applied to some surface of the front housing.

FIG. 11 illustrates an alternative embodiment in which a lossy region is positioned parallel to a column of conductive elements that each form one half of a broad side coupled differential pair. FIG. 11 illustrates a modification to a front housing portion, such as front housing portion 225 (FIG. 2B).

According to some embodiments of the invention, a lossy coating is applied to some surface of front housing portion 1125. In the embodiment illustrated in FIG. 11, a lossy coating 1122 is applied to an external surface on the side of front housing 1125. This coating may be applied in any suitable way, such as by application of a paint, adhesive or other binder containing conductive or partially conductive fibers, flakes or other fillers.

When a wafer subassembly is formed by inserting wafers, such as wafers 230 and 240 (FIG. 2A), into front housing portion 1125, lossy coating 1122 will be in close proximity to the mating contacts of wafers. When two or more such subassemblies are placed together in a daughter card connector, lossy coating 1122 on front housing 1125 effectively forms a lossy segment between columns of mating contacts of adjacent pairs. As discussed above, this arrangement may improve the signal to noise ratio, thereby improving signal integrity.

Figure 12:
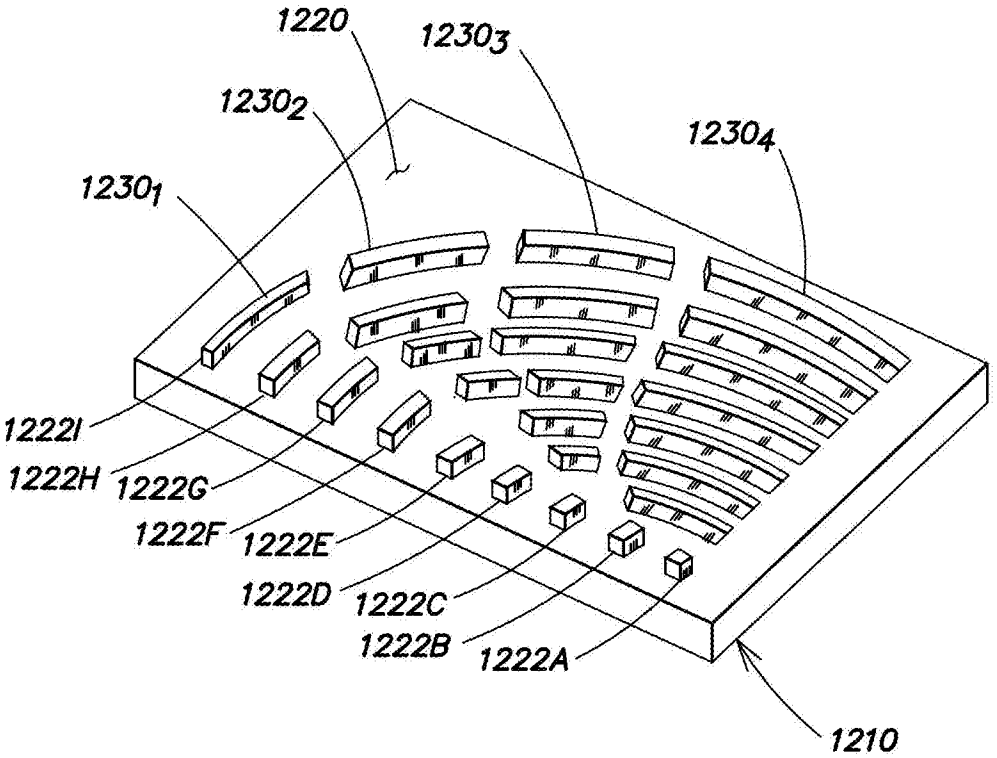
FIG. 12 is a perspective view of a member with lossy portions that may be incorporated into a wafer as illustrated in FIG. 2A according to some alternative embodiments.

As described above, one approach for improving electrical performance involves selectively placing lossy material between adjacent pairs of conductive elements. Such an approach may reduce the amount of signal coupled to a cavity-like structure formed by grounding a pair of conductive elements, resulting in a reduced the amount of resonance induced in the cavity-like structure. One such approach for introducing lossy material is to form filler elements 295 (FIG. 2B) at least partially of lossy material. FIG. 12 illustrates an approach to introducing lossy material that may be used instead of or in addition to incorporating lossy material into filler elements in 295. FIG. 12 illustrates a lossy insert 1210. Lossy insert 1210 may be formed in any suitable way. For example, lossy insert 1210 may be formed by molding a lossy material as described above.

As illustrated in FIG. 12, lossy insert 1210 may be formed with a generally planar portion 1220. Planar portion 1220 may have a profile adapted to fit within a cavity and connector. To use such a lossy insert with a waferized connector, such as is illustrated in FIG. 2A, generally planar portion 1220 may be profiled to fit within a cavity of a wafer, such as cavity 201 in wafer 240. In this way, lossy inserts may be incorporated into the connector without changing the spacing between wafers.

Though FIG. 12 shows a single lossy insert 1210, a lossy insert may be provided for each wafer or for each wafer subassembly. For example, FIG. 2A shows a wafer subassembly containing wafers 240 and 230. A lossy insert may be inserted into cavity 201 on wafer 240. A lossy insert may similarly be inserted into a cavity on an opposite side of wafer 230.

As illustrated in FIG. 12, lossy insert 1210 may be formed with upstanding ribs projecting from the generally planar portion 1210. In the embodiment illustrated in FIG. 12, ribs 1222A . . . 1222I are illustrated. Each of the ribs may be positioned to align with a filler element, such as filler element 295, between adjacent conductive elements within a pair. In this way, the lossy material within each of the ribs may reduce the coupling of energy between pairs, thereby reducing the amount of energy incident on a grounded pair. As a result, the magnitude of any resonance excited by coupling between pairs may be reduced.

In the embodiment illustrated, some or all of the ribs may be segmented. For example, rib 1222I is shown to contain segments $\mathbf{1230}_1$, $\mathbf{1230}_2$, $\mathbf{1230}_3$ and $\mathbf{1230}_4$. Segmenting the ribs may create spaces for portions of the wafer housings.

For example, wafer 240 contains members 203 that provide support for conductive elements and filler elements such as 295. The segments of each rib may be positioned to allow space for members, such as members 203.

Figure 13:
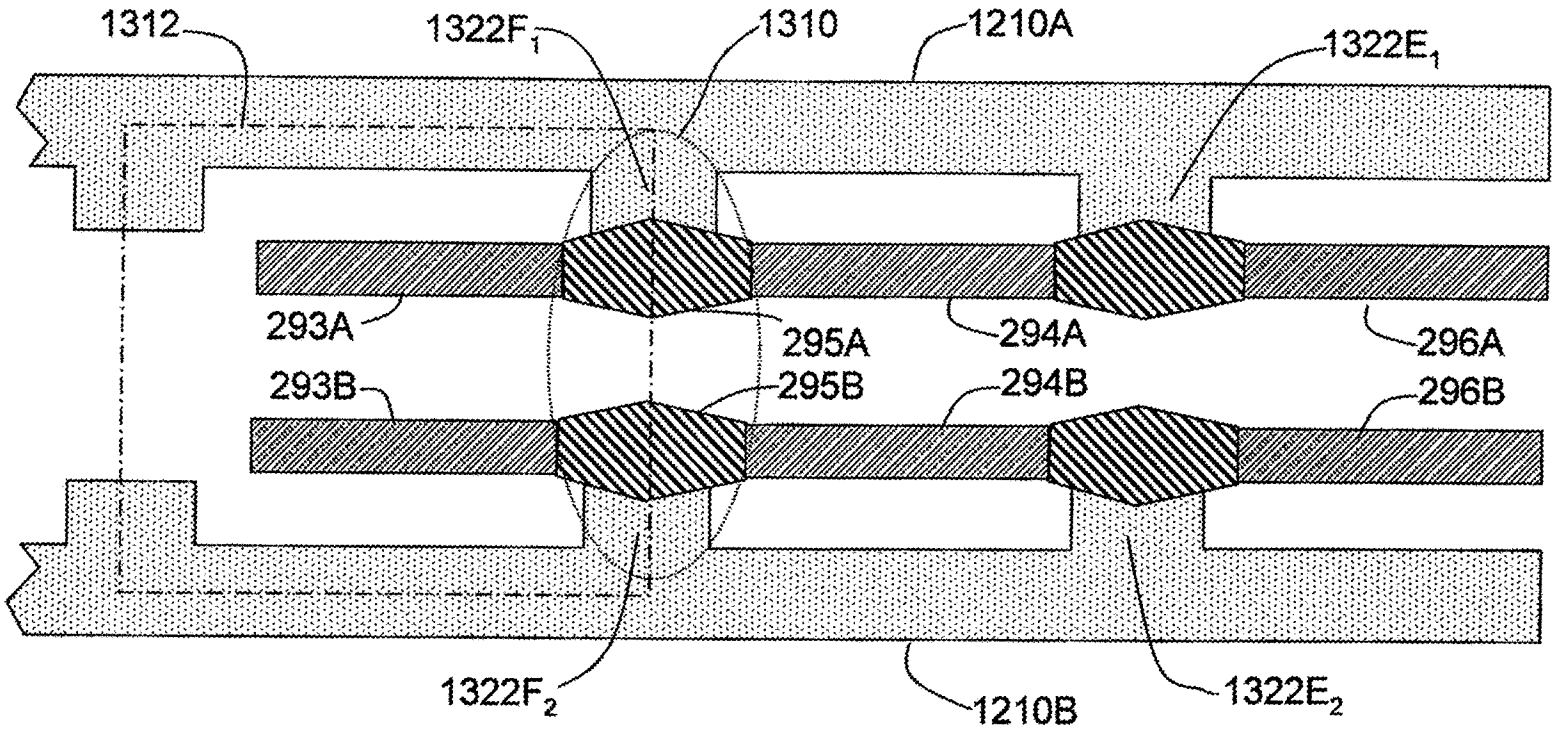
FIG. 13 is a cross-sectional view of a connector incorporating lossy inserts according to some embodiments.

With this configuration, the ribs 1222A . . . 1222I of lossy material may press against the filler elements, such as filler element 295. The ribs are then positioned generally between adjacent pairs of conductive elements, attenuating radiation that may be coupled from one pair to an adjacent pair. FIG. 13 is a cross-section through a portion of a wafer subassembly containing two wafers and two lossy inserts. As illustrated, conductive elements 293A, 294A and 296A form a portion of a column of conductive elements in one wafer in a wafer subassembly. Corresponding conductive elements 293B, 294B and 296B form a portion of a column of conductive elements in a second wafer in a wafer subassembly. Lossy insert 1210A is positioned in the first wafer, and lossy insert 1210B is positioned in the second wafer. As shown, the ribs from each lossy insert are positioned between conductive elements in adjacent pairs. For example, rib 322$F_1$ is positioned between conductive elements 293A and 294A. Accordingly, rib 1322$F_1$ may reduce radiation coupling between conductive element 293A and 294A. Similarly, rib 1322$F_2$ on lossy insert 1210B is positioned between conductive elements 293B and 294B. Rib 1322$F_2$ may reduce coupling between conductive elements 293B and 294B.

One or both of lossy inserts 1210A and 1210B may be used to reduce coupling between the pairs formed by conductive elements 1293A and 1293B and a second pair formed by conductive elements 1294A and 1294B. Similar ribs, such as ribs 1322$E_1$ and 1322$E_2$ may be used to reduce coupling between other pairs formed by the conductive elements in the wafer subassemblies.

In some embodiments, all or portions of the lossy inserts may be formed of lossy material. For example, the ribs of the lossy inserts may be formed of lossy material. Though other portions of the lossy inserts, such as planar portions 1220 (FIG. 12) may be formed of an insulative material or other suitable material. Though, in other embodiments, at least a portion of the generally planar portions 1220 (FIG. 12) may be formed of a lossy material.

As illustrated in FIG. 13, the lossy inserts may be entirely formed of lossy material. In that embodiment, each pair may be generally surrounded by lossy material. As illustrated in FIG. 13, lossy material around the pair formed by conductive elements 1293A and 1293B approximates a square 1312. In addition to reducing coupling between pairs within a wafer subassembly, a square of lossy material may reduce the coupling from subassembly to subassembly.

It should be appreciated that FIG. 13 illustrates some embodiments of a connector including lossy inserts and other embodiments are possible. For example, wafer subassemblies may be formed without filler elements such as filler element 295. In such embodiments, ribs, such as 1322$F_1$ and 1322$F_2$ may be made long enough to substantially fill region 1310. In such an embodiment, the ribs may be made partially insulative to avoid shorting conductive elements within the wafer subassembly. For example, each of the ribs could have a lossy coating or other mechanism to prevent electrical contact with conductive elements. In other embodiments, the ribs may be omitted entirely.

Figure 14:
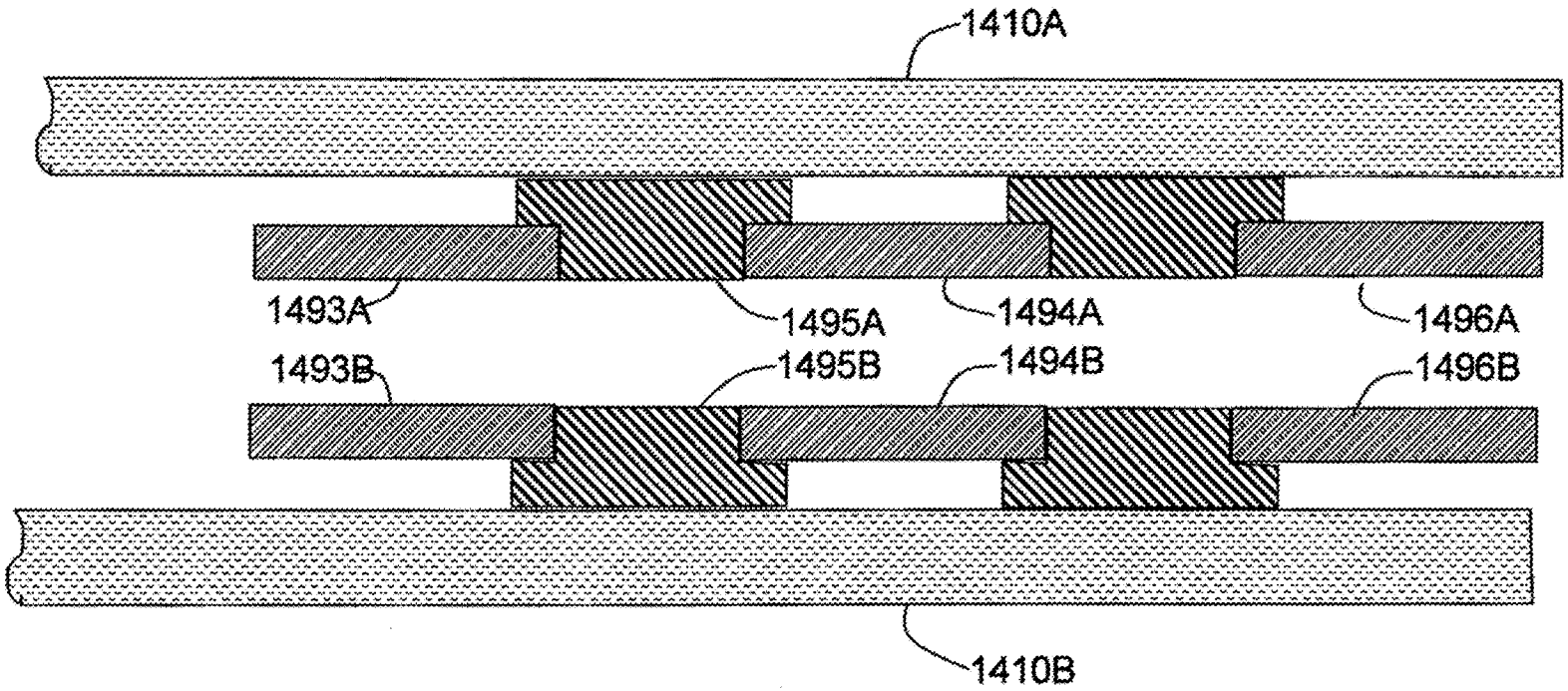
FIG. 14 is a cross-sectional view of a connector incorporating ferrite loaded inserts according to some embodiments.

FIG. 14 illustrates an embodiment in which inserts without ribs are used. FIG. 14 shows in cross section a portion of a wafer subassembly. In the illustrated embodiment, the wafer subassembly includes two wafers held side-by-side. The conductive members of the wafers form pairs, including pairs of conductive members 1493A, 1493B and 1494A, 1494B and 1496A, 1496B. The pairs may be separated by filler elements, such as filler elements 1495A and 1495B.

In addition to separating adjacent pairs of conductive members, the filler elements also provide a mechanism to separate lossy inserts from the conductive elements. In the embodiment illustrated, inserts 1410A and 1410B are shown. In the example of FIG. 14, the inserts do not contact any of the conductive members. Though some of the conductive members may, in use, be grounded, conductive members are not designated for this purpose when the connector is designed. Thus, it is not possible to design the connector to electrically connect an insert to only conductive members used as ground. As a result, filler elements, such as 1495A and 1495B, are positioned to separate the inserts from all of the conductive members. Though, other embodiments are possible in which the inserts are coupled to certain conductive members.

In the embodiment of FIG. 14, the inserts are ferrite filled. The inserts, for example, could be cut from a sheet of ferrite filled material. A material that has an elastomeric matrix with ferrite fillers could be used. Such material is commercially available under the trade name ECCOSORB® BSR, though any suitable material may be used. Such an insert could be held in place in any suitable way. For example, the inserts may be held in place through an interference fit with the walls of a cavity, such as cavity 201 in wafer 240 (FIG. 2A). Alternatively, an adhesive or other attachment mechanism may be used.

Ferrite filled inserts, though adjacent signal conductors, are found not to significantly reduce the signal levels carried by those conductors, particularly when the signal conductors are configured as differential pairs. Nonetheless, such material significantly reduces cross talk because less energy that could induce resonance is coupled to grounded pairs and less energy from the resonating pairs is coupled to surrounding pairs.

In the embodiment illustrated in FIG. 14, magnetically lossy material, as opposed to electrically lossy material, can be incorporated into a connector after it has been designed. Inserts also can be selectively included in some connectors, but not others, allowing the same connector design to be used in different applications with different electrical properties. However, the invention is not limited in this respect. A structure as illustrated in FIG. 14 alternatively may be incorporated as a fixed part of a connector design.

Having thus described several aspects of at least one embodiment of this invention, it is to be appreciated various alterations, modifications, and improvements will readily occur to those skilled in the art.

For example, in the embodiments described above, lossy material is incorporated into a daughter card connector. Lossy material may be similarly incorporated into any suitable type of connector, including a backplane connector. For example, lossy regions may be formed in the floor 162 of shroud 160. Lossy regions may be formed in shroud 160 using a two shot molding operation, by inserting lossy members into openings in shroud 160 or in any other suitable way.

Also, it was described that lossy material was incorporated in mating contact regions of a connector because those regions both support common mode signal and contribute to mode conversion. Coupling between conductive elements in a pair is also relatively weak in these regions in comparison to the tightly coupled intermediate portions. Similar parameters may exist near the contact tails of a connector. Thus in some embodiments, lossy material alternatively or additionally may be selectively positioned adjacent the contact tails of a connector. Moreover, the conditions that give rise to the selection of the mating contact regions in embodiments described above may exist in other locations within an interconnection system. For example, similar conditions may exist within a backplane connector or elsewhere within an interconnection system.

Further, multiple characteristics are described that led to selection of the mating contact regions for selective placement of lossy material. Regions for lossy material may be selected even if all such characteristics do not exist in the selected locations.

Embodiments are described above in which lossy material is positioned between the tightly coupled portions of adjacent pairs or between loosely coupled portions of the pairs. These, and other approaches, may be combined in a single connector. Though, in some embodiments, lossy material between adjacent pairs in the vicinity of tightly coupled portions may have a relatively small effect because, in tightly coupled regions, most energy propagates between the conductive elements of a pair and little energy exists between the pairs to be attenuated by the lossy material. In such embodiments, the regions between tightly coupled pairs, either within a column or between columns, may be substantially free of lossy material. Omitting lossy material adjacent tightly coupled regions may be desirable for cost or manufacturability.

Such alterations, modifications, and improvements are intended to be part of this disclosure, and are intended to be within the spirit and scope of the invention. Accordingly, the foregoing description and drawings are by way of example only.

What is claimed is:

1. A component for use in an electrical connector, the component comprising:
- an insulative housing;
- a plurality of conductive elements, wherein:
  - each conductive element of the plurality of conductive elements comprises a contact tail, a mating contact portion, and an intermediate portion extending between the contact tail and the mating contact portion;
  - the intermediate portions of the plurality of conductive elements extend through the insulative housing;
  - the plurality of conductive elements comprise a first conductive element and a second conductive element adjacent the first conductive element; and
  - the mating contact portions of the first and second conductive elements are aligned edge to edge; and
- a lossy insert that is separately manufactured and assembled with the insulative housing, wherein the lossy insert is disposed adjacent a transition region between the intermediate portion of the first conductive element and the mating contact portion of the first conductive element.

2. The component of claim 1, wherein the plurality of conductive elements comprises a plurality of pairs of conducive elements, each pair of the plurality of pairs of conductive elements being adapted to carry a differential signal.

3. The component of claim 1, wherein the insulative housing comprises a cavity adapted to receive the lossy insert.

4. The component of claim 1, wherein:
- the lossy insert is a first lossy insert;
- the component further comprises a second lossy insert that is separately manufactured and assembled with the insulative housing; and
- the second lossy insert is disposed adjacent a transition region between the intermediate portion of the second conductive element and the mating contact portion of the second conductive element.

5. The component of claim 1, wherein the lossy insert comprising a protruding portion that protrudes toward the first conductive element.

6. The component of claim 1, wherein the lossy insert comprises a material having a conductivity of about 1 siemens/meter to about $1\times10^7$ siemens/meter.

7. The component of claim 1, wherein the lossy insert comprises a material having a conductivity of about 1 siemens/meter to about 30,000 siemens/meter.

8. The component of claim 1, wherein the lossy insert comprises a material having a conductivity of about 25 siemens/meter to about 500 siemens/meter.

9. The component of claim 1, wherein the lossy insert comprises a material having a surface resistivity between 1 Ω/square and $10^3$ Ω/square.

10. The component of claim 1, wherein the lossy insert comprises a material having a surface resistivity between 10 Ω/square and 100 Ω/square.

11. The component of claim 1, wherein the lossy insert comprises a material having a surface resistivity between 20 Ω/square and 40 Ω/square.

12. An electrical connector comprising a plurality of components, wherein at least one component of the plurality of components comprises:
- an insulative housing;
- a plurality of conductive elements, wherein:
  - each conductive element of the plurality of conductive elements comprises a contact tail, a mating contact portion, and an intermediate portion extending between the contact tail and the mating contact portion;
  - the intermediate portions of the plurality of conductive elements extend through the insulative housing;
  - the plurality of conductive elements comprise a first conductive element and a second conductive element adjacent the first conductive element; and
  - the mating contact portions of the first and second conductive elements are aligned edge to edge; and
- a lossy insert that is separately manufactured and assembled with the insulative housing, wherein the lossy insert is disposed adjacent a transition region between the intermediate portion of the first conductive element and the mating contact portion of the first conductive element.

13. The electrical connector of claim 12, wherein each component of the plurality of components is a wafer.

14. The electrical connector of claim 13, wherein the plurality of conductive elements comprises a plurality of pairs of conducive elements, each pair of the plurality of pairs of conductive elements being adapted to carry a differential signal.

15. The electrical connector of claim 13, wherein:
- the lossy insert is a first lossy insert;
- the component further comprises a second lossy insert that is separately manufactured and assembled with the insulative housing; and
- the second lossy insert is disposed adjacent a transition region between the intermediate portion of the second conductive element and the mating contact portion of the second conductive element.

16. The electrical connector of claim 12, wherein the lossy insert comprising a protruding portion that protrudes toward the first conductive element.

17. The electrical connector of claim 12, wherein the lossy insert comprises a material having a conductivity of about 1 siemens/meter to about 30,000 siemens/meter.

18. The electrical connector of claim 12, wherein the lossy insert comprises a material having a conductivity of about 25 siemens/meter to about 500 siemens/meter.

19. The electrical connector of claim 12, wherein the lossy insert comprises a material having a surface resistivity between 10 Ω/square and 100 Ω/square.

20. The electrical connector of claim 12, wherein the lossy insert comprises a material having a surface resistivity between 20 Ω/square and 40 Ω/square.

* * * * *